US008342667B2

(12) United States Patent
Tsuchiya et al.

(10) Patent No.: US 8,342,667 B2
(45) Date of Patent: Jan. 1, 2013

(54) AUXILIARY PASSAGE UNIT, LIQUID DISCHARGE HEAD HAVING THE SAME ATTACHED THERETO, ATTACHMENT, INK JET HEAD HAVING THE SAME ATTACHED THERETO, AND INK JET PRINTER

(75) Inventors: Kenji Tsuchiya, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 524 days.

(21) Appl. No.: 12/409,191

(22) Filed: Mar. 23, 2009

(65) Prior Publication Data

US 2009/0237470 A1 Sep. 24, 2009

(30) Foreign Application Priority Data

Mar. 24, 2008 (JP) ..... 2008-075062
Mar. 24, 2008 (JP) ..... 2008-075063

(51) Int. Cl.
*B41J 2/19* (2006.01)

(52) U.S. Cl. ..... 347/92; 347/94

(58) Field of Classification Search ..... 347/92, 347/94

See application file for complete search history.

(56) References Cited

U.S. PATENT DOCUMENTS

| | | | | |
|---|---|---|---|---|
| 6,116,727 | A | 9/2000 | Hagiwara | |
| 6,520,633 | B2 * | 2/2003 | Nakamura | 347/93 |
| 7,159,966 | B2 * | 1/2007 | Taira | 347/47 |
| 7,278,710 | B2 * | 10/2007 | Hirota et al. | 347/54 |
| 7,891,797 | B2 * | 2/2011 | Chikamoto et al. | 347/93 |
| 7,931,361 | B2 * | 4/2011 | Nishizaki | 347/94 |
| 2005/0206691 | A1 * | 9/2005 | Takata et al. | 347/84 |
| 2007/0070115 | A1 * | 3/2007 | Shindo | 347/29 |
| 2007/0229602 | A1 | 10/2007 | Taira et al. | |
| 2007/0229634 | A1 | 10/2007 | Chikamoto et al. | |
| 2009/0237455 | A1 * | 9/2009 | Hirota | 347/47 |

FOREIGN PATENT DOCUMENTS

| | | | |
|---|---|---|---|
| JP | 2000-062204 | A | 11/1999 |
| JP | 2007-268829 | A | 10/2007 |
| JP | 2007-268868 | A | 10/2007 |

* cited by examiner

*Primary Examiner* — Charlie Peng
(74) *Attorney, Agent, or Firm* — Baker Botts L.L.P.

(57) ABSTRACT

An auxiliary passage apparatus, an attachment, a liquid discharge head, and a ink jet head are provided. The auxiliary passage apparatus is detachably attached to a liquid discharge head and includes a main body portion including, a first surface, a second surface, a supply passage formed in the first surface and through which liquid passes to a discharge head, and an ejection passage formed in the second surface and through which liquid which is ejected from the discharge head passes. A part of the supply passage includes a first annular projection formed so as to protrude in a direction orthogonal to the first surface and a first flexible film adhered to a distal end of the first annular projection. A part of the ejection passage crosses an area on the second surface which is opposed to an area surrounded by the first annular projection.

7 Claims, 18 Drawing Sheets

AUXILIARY PASSAGE UNIT, LIQUID DISCHARGE HEAD HAVING THE SAME ATTACHED THERETO, ATTACHMENT, INK JET HEAD HAVING THE SAME ATTACHED THERETO, AND INK JET PRINTER

CROSS-REFERENCE TO RELATED APPLICATIONS

This application claims priority from Japanese Patent Application No. 2008-075062 filed on Mar. 24, 2008, and Japanese Patent Application No. 2008-075063 filed on Mar. 24, 2008, the entire contents of which are incorporated herein by reference.

TECHNICAL FIELD

Apparatuses and devices consistent with the present invention relate to an auxiliary passage unit attached to a liquid discharge head that discharges a liquid to a recording medium, a liquid discharge head having the auxiliary passage unit attached thereto, an attachment, an ink jet head having the attachment attached thereto, and an ink jet printer.

BACKGROUND

A related art ink jet head attached to an ink jet printer has been known as one of the liquid discharge heads for discharging a liquid. Some ink jet heads are provided with a passage unit in which a common ink chamber and a plurality of individual ink passages from the common ink chamber to nozzles are formed, and a reservoir unit in which a reservoir communicating with the common ink chamber and an ink supply port for supplying ink to the reservoir are formed. In such a related art ink jet head, ink is supplied into a reservoir of the reservoir unit via an ink tube that functions as an ink supply passage connected to an ink supply port. However, sometimes air remaining in an ink tube is introduced into the reservoir along with ink via an ink supply port by a pump which sends ink into the reservoir. Air in the reservoir causes clogging of minute nozzles. If a nozzle is clogged, the discharge performance of ink drops is worsened. Therefore, JP-A-2007-268868 describes a related art ink jet head in which an ink ejection port for discharging air in the reservoir to the outside is formed, and at the same time, an ink tube functioning as an ink ejection passage is connected to the ink ejection port.

Also, JP-A-2007-268829 describes a related art reservoir unit having a plate-shaped passage component. An annular projection protruding in a direction orthogonal to one surface of the passage component is formed on the corresponding surface. A film is adhered to the tip end of the annular projection, and a spacing surrounded by the inner circumferential surface of the annular projection and the film forms a part of the ink passage. Therefore, a radical fluctuation in pressure of ink in the reservoir unit can be absorbed by flexing of the film. This flexing acts as a damper function. In addition, surrounding the annular projection in the passage component, a rib protruding in the direction orthogonal to the surface is formed in order to prevent deformation by increasing the rigidity of the passage component.

Where two passages of an ink supply passage and an ink ejection passage, which are connected to an ink supply port and an ink ejection port of the ink jet head described in JP-A-2007-268868 described above, respectively, are formed on an attachment detachable from the ink jet head, it becomes possible to connect the two passages to the ink jet head by a single operation. However, the attachment having two passages thus mounted therein is liable to be large-sized.

Also, where there is unevenness between the pitch of the ink supply port and the ink ejection port, which are formed in the ink jet head, and the pitch of connection portions of the ink supply port and the ink ejection port, which are formed in the attachment, a connection between both cannot be normally carried out. That is, in such a case, a load may be given to the ink supply port and the ink ejection port, wherein there is a fear that ink leakage occurs.

In addition, it is advantageous to increase the area, in which the annular projection is formed, as much as possible, and to increase the area of the film adhered to the tip end of the annular projection in order to increase the damper function of the passage component. However, since it is difficult to form the rib to increase the rigidity in an area surrounded by the annular projection, the rigidity may be remarkably lowered if the area in which the annular projection is formed is increased.

Therefore, where the damper function as described in JP-A-2007-268829 is given to the attachment having the ink supply passage and the ink ejection passage formed therein, there is a fear that the attachment is deformed by a force received when the attachment is mounted in an ink jet head, and ink may leak at a connection portion with the ink jet head.

SUMMARY

Illustrative aspects of the present invention provide a small-sized auxiliary passage unit capable of preventing deformation, a liquid discharge head having the auxiliary passage unit attached thereto, an attachment, an ink jet head having the attachment attached thereto, and an ink jet printer.

Illustrative aspects of the present invention also provide an attachment capable of reducing a load given to an ink supply port and an ink ejection port, an ink jet head having the attachment attached thereto, and an ink jet printer.

According to an illustrative aspect of the present invention, there is provided an auxiliary passage apparatus which is detachably attached to a liquid discharge head, the auxiliary passage unit comprising a main body portion comprising, a first surface, a second surface, a supply passage formed in the first surface and through which liquid passes to a discharge head, and an ejection passage formed in the second surface and through which liquid which is ejected from the discharge head passes; wherein at least a part of the supply passage comprises a first annular projection formed so as to protrude in a direction orthogonal to the first surface and a first flexible film adhered to a distal end of the first annular projection; and at least a part of the ejection passage crosses an area on the second surface which is opposed to an area surrounded by the first annular projection.

According to another illustrative aspect of the present invention, there is provided a liquid discharge head comprising: a liquid passage which distributes liquid to a plurality of nozzles that discharge liquid drops onto a recording medium; a liquid supply port which supplies liquid to the liquid passage; a liquid ejection port which ejects liquid from the liquid passage; and an auxiliary passage unit which is detachably attached to the liquid supply port and the liquid ejection port, and which comprises: a main body portion comprising, a first surface, a second surface, a supply passage formed in the first surface and through which liquid passes to a discharge head, and an ejection passage formed in the second surface and through which liquid which is ejected from the discharge head passes; wherein at least a part of the supply passage comprises a first annular projection formed so as to protrude in a direction orthogonal to the first surface and a first flexible film adhered to a distal end of the first annular projection; and at least a part of the ejection passage crosses an area on the second surface which is opposed to an area surrounded by the first annular projection.

According to yet another illustrative aspect of the present invention, there is provided an attachment which is detachably attached to an ink jet head, the attachment comprising: a main body portion comprising a first surface, a second surface, a supply passage formed on the first surface and through which ink supplied to the ink jet head passes, and an ejection passage formed on the second surface and through which ink ejected from the ink jet head passes; a first hollow communication tube protruding from the second surface and comprising a first slit formed in a distal end thereof through which the supply passage and the ink jet head communicate with each other; and a second hollow communication tube protruding from the second surface and comprising a second slit formed in a distal end thereof through which the ejection passage and the ink jet head communicate with each other; wherein at least a part of the supply passage comprises opposite portions, each of which extends along an end edge portion parallel to the main body portion on the first surface, linkage portions that connect the opposite portions to each other, and a first flexible film adhered to the distal ends of the opposite portions and the linkage portions; and at least a part of the ejection passage comprises a second annular projection, which extends in a substantially straight manner from one end edge part of the main body portion toward the other end edge part thereof so as to cross the linkage portions, the second annular projection protruding in a direction orthogonal to the second surface, and a second flexible film adhered to the distal end of the second annular projection.

According to yet another illustrative aspect of the present invention, there is provided an ink jet head comprising: an ink passage which distributes ink to a plurality of nozzles that discharge ink drops onto a recording medium; an ink supply port which supplies ink to the ink passage; an ink ejection port which ejects ink from the ink passage; and an attachment which is detachably attached to the ink supply port and the ink ejection port, and which comprises: a main body portion comprising a first surface, a second surface, a supply passage formed on the first surface and through which ink supplied to the ink jet head passes, and an ejection passage formed on the second surface and through which ink ejected from the ink jet head passes; a first hollow communication tube protruding from the second surface and comprising a first slit formed in a distal end thereof through which the supply passage and the ink jet head communicate with each other; and a second hollow communication tube protruding from the second surface and comprising a second slit formed in a distal end thereof through which the ejection passage and the ink jet head communicate with each other; wherein at least a part of the supply passage comprises opposite portions, each of which extends along an end edge portion parallel to the main body portion on the first surface, linkage portions that connect the opposite portions to each other, and a first flexible film adhered to the distal ends of the opposite portions and the linkage portions; and at least a part of the ejection passage comprises a second annular projection, which extends in a substantially straight manner from one end edge part of the main body portion toward the other end edge part thereof so as to cross the linkage portions, the second annular projection protruding in a direction orthogonal to the second surface, and a second flexible film adhered to the distal end of the second annular projection.

According to yet another illustrative aspect of the present invention, there is provided an attachment detachably attached to an ink jet head, the attachment comprising: a main body portion formed of a flexible material and comprising a first surface, and a second surface which is opposite to the first surface and in which a supply passage through which ink supplied to the ink jet head passes and an ejection passage through which ink ejected from the ink jet head passes are formed; a first connection portion and a second connection portion being provided so as to protrude on the surface of the first surface, the first connection portion causing the supply passage to communicate with the ink jet head and the second connection portion causing the ejection passage to communicate with the ink jet head, when the attachment is attached to the ink jet head; wherein the main body portion further comprises a beam-shaped passage portion delimited by a slit formed along both sides of one of the supply passage and the ejection passage with respect to a pitch direction connecting the first connection portion and the second connection portion to each other on the first surface; and the connection portion corresponding to the beam-shaped passage portion of the first connection portion and the second connection portion is linked to the beam-shaped passage portion displaceably in the pitch direction.

BRIEF DESCRIPTION OF THE DRAWINGS

FIGS. 15A and 15B are sectional views of the attachment shown in FIG. 14A, wherein FIG. 15A is a sectional view taken along a line XVA-XVA in FIG. 14A, and FIG. 15B is a sectional view taken along a line XVB-XVB in FIG. 14A;

DESCRIPTION OF EXEMPLARY EMBODIMENTS

Hereinafter, a description will be given of exemplary embodiments of the present invention with reference to the drawings.

First Exemplary Embodiment

Figure 1:
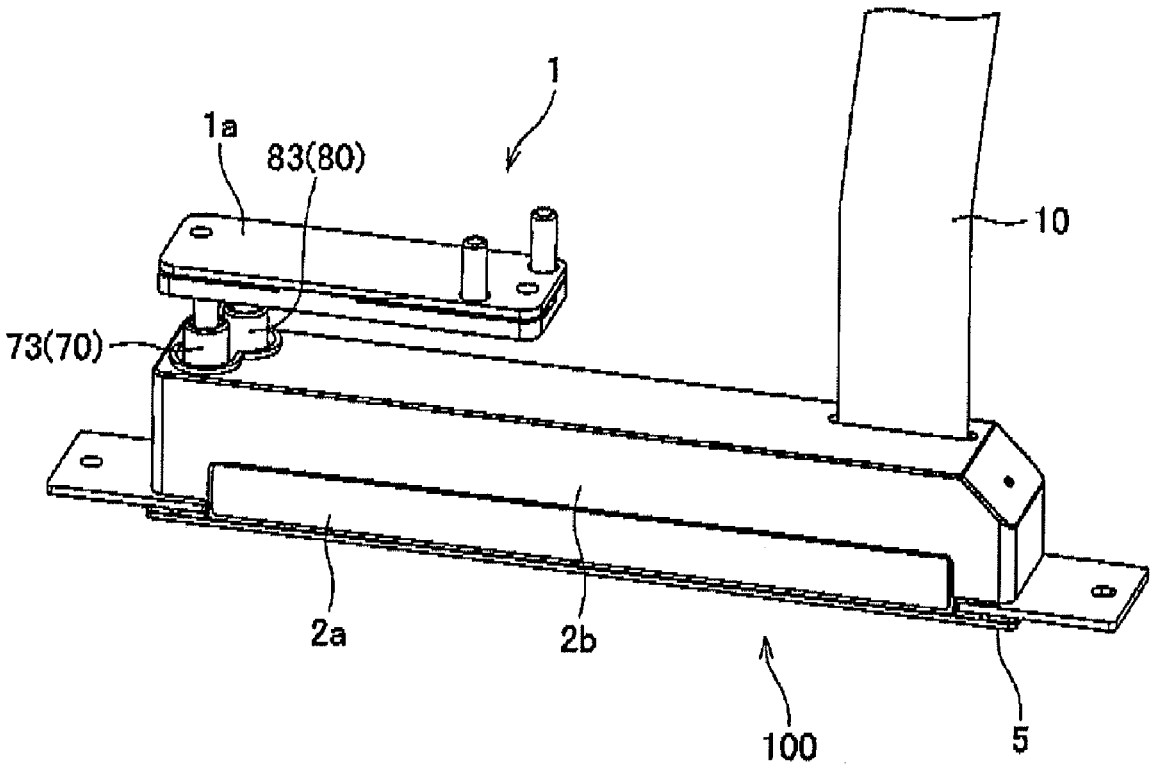
FIG. 1 is a conceptual perspective view of an ink jet head in a state in which an attachment according to one of first to third exemplary embodiments of the present invention is attached.
Figure 2:
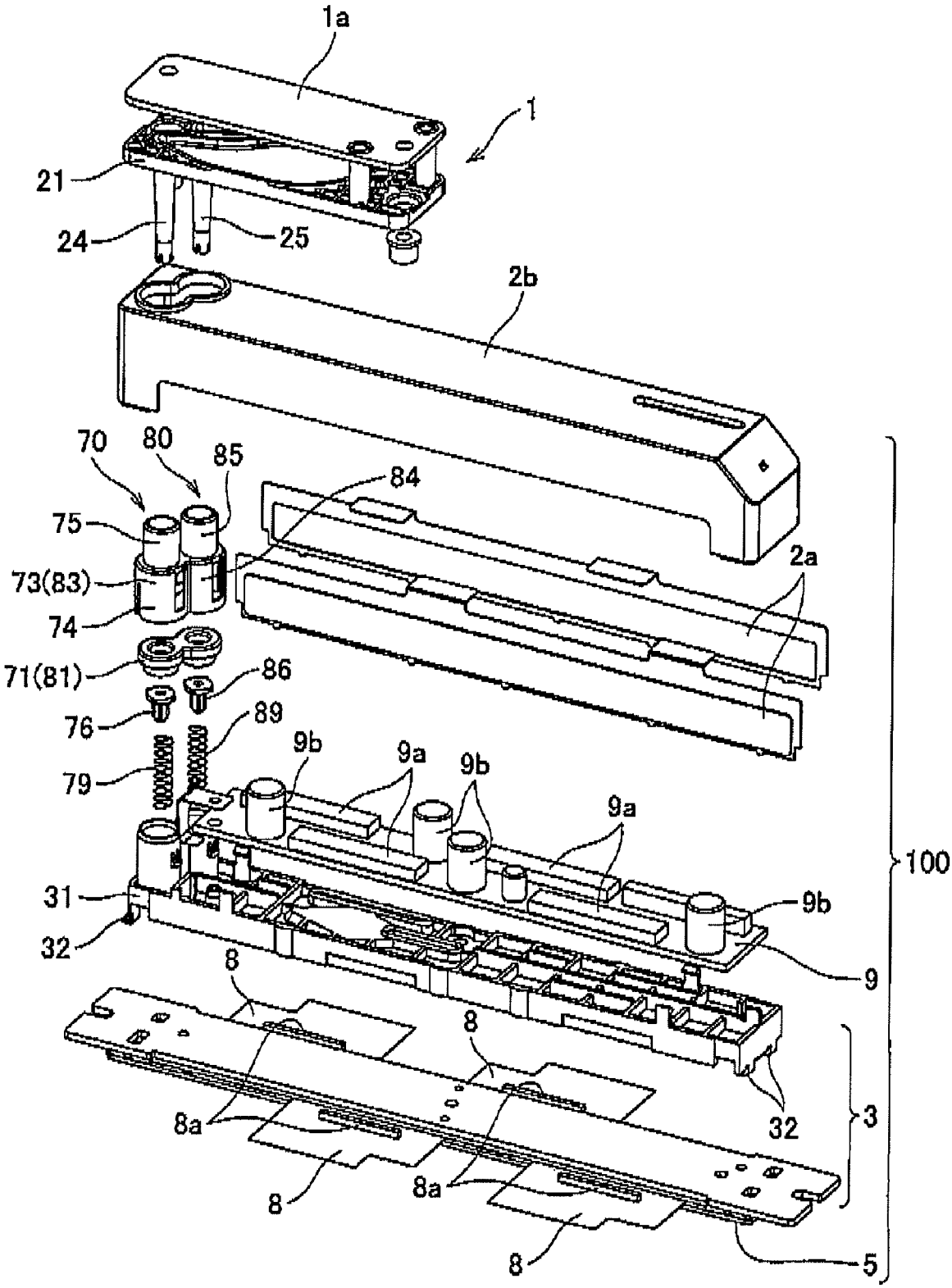
FIG. 2 is a disassembled perspective view of the attachment and the ink jet head, which are shown in FIG. 1.
Figure 3:
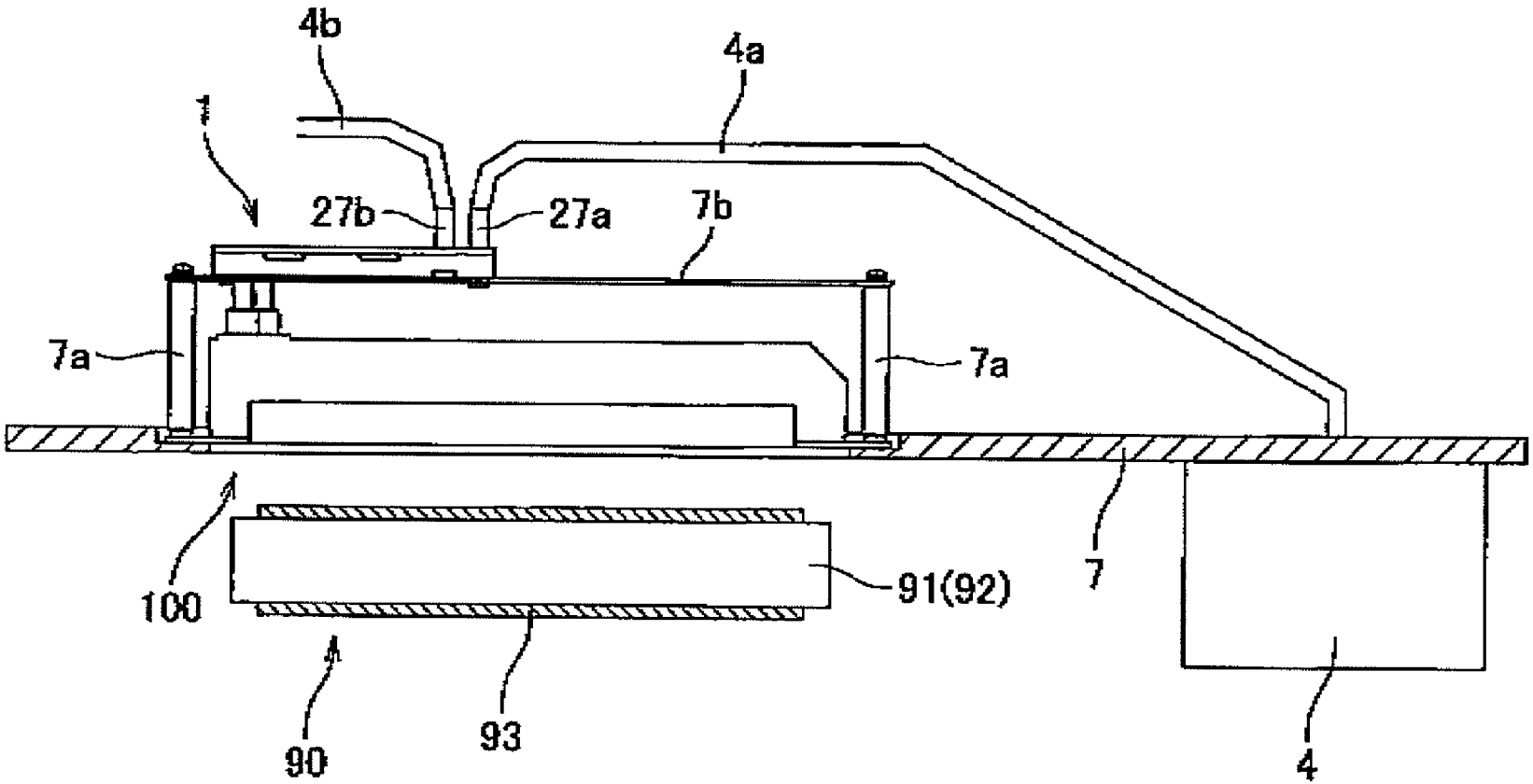
FIG. 3 is a view showing an example of a printer in which the ink jet head shown in FIG. 1 is installed.

An attachment according to the first exemplary embodiment is attached to an ink jet head provided in an ink jet printer. FIG. 1 is a conceptual perspective view of an ink jet head in a state in which an apparatus (hereinafter referred to as an attachment) according to the first exemplary embodiment of the present invention is attached thereto. FIG. 2 is a disassembled perspective view of the attachment and the ink jet head, which are shown in FIG. 1. FIG. 3 is a view showing a printer in which the ink jet head shown in FIG. 1 is installed.

As shown in FIG. 3, an ink jet head 100 is fixed at the frame 7 of a printer in a state where the ink jet head 100 is attached to an attachment 1. The frame 7 is installed upward of a conveyance mechanism 90 that conveys sheets in a direction perpendicular to the paper surface of FIG. 3. The conveyance mechanism 90 comprises an endless conveyance belt 93 applied on a pair of rollers 91, 92, the rotation axes of which are parallel to each other. Note that in FIG. 3, the second roller 92 of the pair of rollers is disposed behind the first roller 91 of the pair of rollers in the figure. The ink jet head 100 is opposed to the upper surface of the conveyance belt 93 and forms images by discharging ink onto sheets conveyed by the conveyance mechanism 90.

The attachment 1 is supported by a supporting plate 7*b* bridged on props 7*a* fixed on the frame 7. Therefore, even if a force is given to the attachment 1, a connected state of the attachment 1 and the ink jet head 100 can be maintained with no unreasonable force applied to a linkage portion between the attachment 1 and the ink jet head 100. In addition, an ink tank 4 is disposed below the frame 7. Ink in the ink tank 4 is conveyed to the ink jet head 100 via the supply tube 4*a* connected to the attachment 1 and via the attachment 1. An ejection tube 4*b* for ejecting ink in the ink jet head 100 to the outside thereof is connected to the attachment 1.

Here, a detailed description will be given of the ink jet head 100 as shown in FIGS. 1 and 2. As shown in FIG. 1, the ink jet head 100 has a slender shape in one direction in plan view. Also, in the first exemplary embodiment, the slender direction in the plan view of the ink jet head 100 is the main scanning direction, and the direction orthogonal to the main scanning direction in the plan view is the sub-scanning direction. Further, the main scanning direction and the sub-scanning direction are orthogonal to each other, the discharge direction of ink that is discharged from the ink jet head 100 is the downward direction, and the direction opposed to the downward direction is the upward direction.

As shown in FIG. 2, the ink jet head 100 includes a reservoir unit 3 in which a reservoir 41 (Refer to FIG. 4) for temporarily reserving ink is formed and a passage unit 5 in which a plurality of ink passages 65 (Refer to FIG. 8) communicating with a plurality of nozzles 61, respectively, are formed and ink is supplied from the reservoir unit 3 positioned above. As described in more detail later, an ink supply port 42 for supplying ink to the reservoir 41 and an ink ejection port 43 for ejecting ink of the reservoir 41 are formed in the reservoir unit 3 (Refer to FIG. 4). And, a supply valve mechanism 70 and an ejection valve mechanism 80 are attached to the ink supply port 42 and the ink ejection port 43, respectively.

Figure 7:
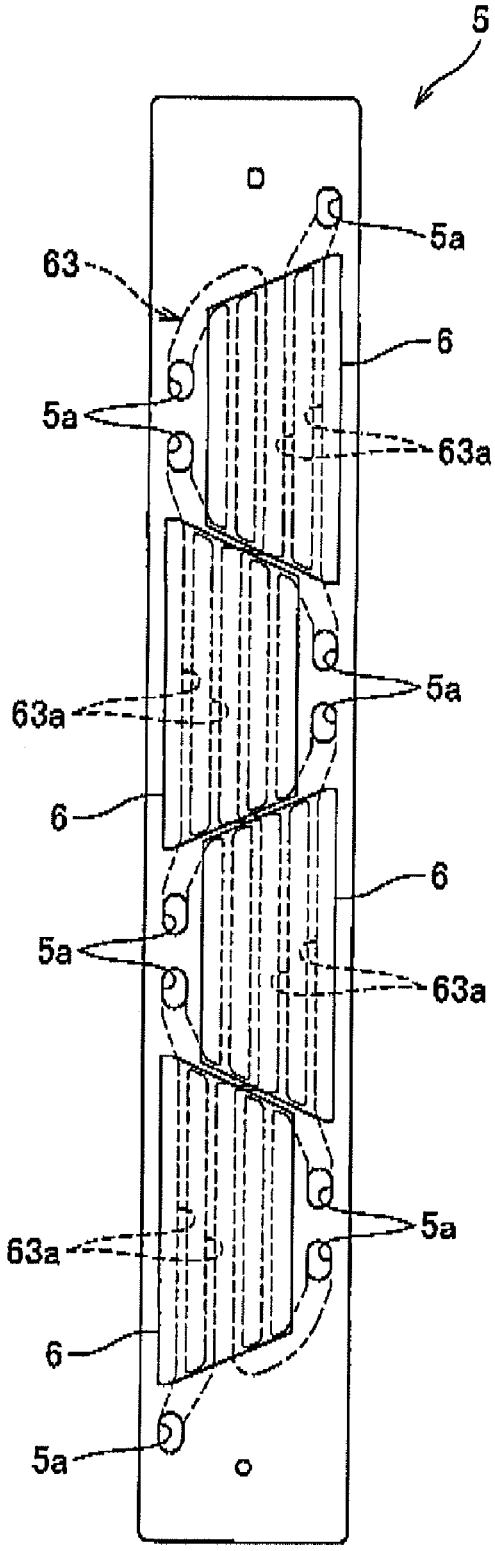
FIG. 7 is a plan view showing a passage unit of the ink jet head shown in FIG. 2.

As described in more detail later, four actuator units 6 are fixed on the upper surface of the passage unit 5 (Refer to FIG. 7). And, an FPC (Flexible Printed Circuit) 8 being a wiring member is adhered to the actuator unit 6. Also, a substrate 9 on which electronic components such as a connector 9*a* and a capacitor 9*b* are mounted is disposed above the reservoir unit 3. The FPC 8 is drawn upward along the side of the reservoir unit 3 from between the passage unit 5 and the reservoir unit 3, and is connected to the connector 9*a* of the substrate 9. In addition, a driver integrated circuit (IC) 8*a* is mounted halfway from the actuator unit 6 to the substrate 9 in the FPC 8.

Also, the substrate 9 is electrically coupled to a control unit (not illustrated), which controls the printer having the ink jet head 100 incorporated therein, via the Flexible Flat Cable (FFC) 10 shown in FIG. 1. Signals are thereby transmitted from the control unit to the driver IC 8*a* via the FPC 8 after being relayed by the substrate 9, and drive signals output from the driver IC 8*a* are supplied to the actuator unit 6. Further, the substrate 9 and the FPC 8 are covered by a side cover 2*a* and a head cover 2*b*.

Figure 4:
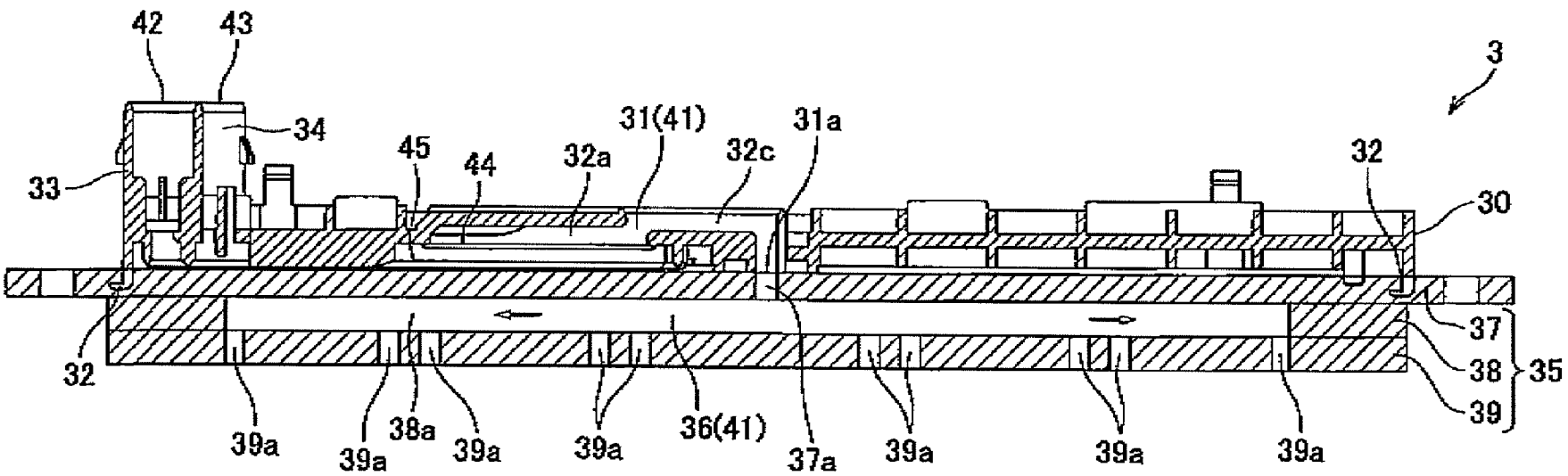
FIG. 4 is a sectional view taken along a main scanning direction of a reservoir unit of the ink jet head shown in FIG. 2.

Next, a detailed description will be given of the reservoir unit 3 with reference to FIG. 4. FIG. 4 is a sectional view taken along the main scanning direction of the reservoir unit 3. Also, for the convenience of explanation, the scale in the up and down direction is enlarged, and a passage not normally depicted in the sectional view along the same line is appropriately shown. As shown in FIG. 4, the reservoir unit 3 is formed as a laminated structure in which the upper reservoir forming body 30 extending in the main scanning direction and three plates 37 through 39 extending in the main scanning direction are laminated. Also, a lower reservoir forming body 35 comprises the plates 37 through 39 laminated to each other.

Figure 5A:
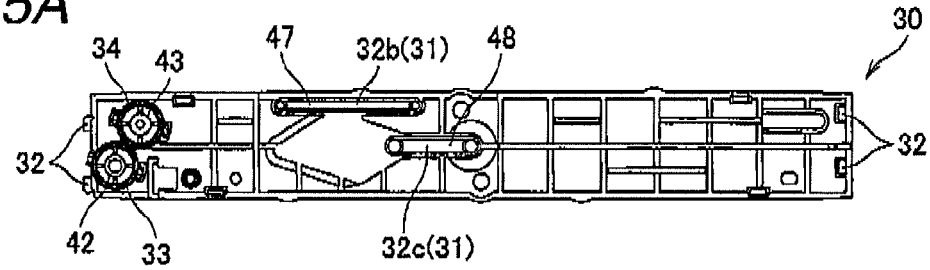
FIGS. 5A through 5E are plan views showing respective components of the reservoir unit shown in FIG. 4.
Figure 5B:
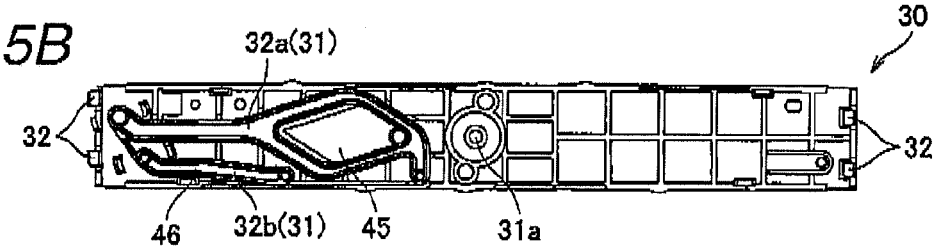
Figure 5C:
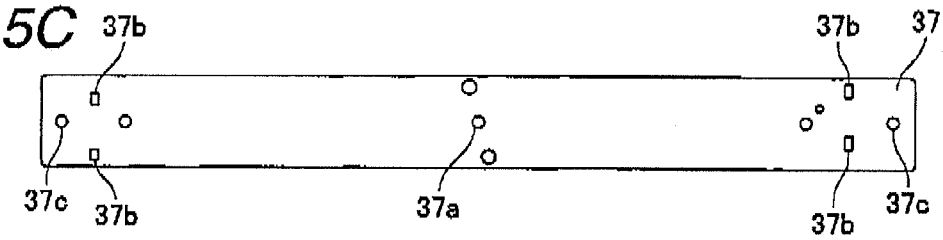
Figure 5D:
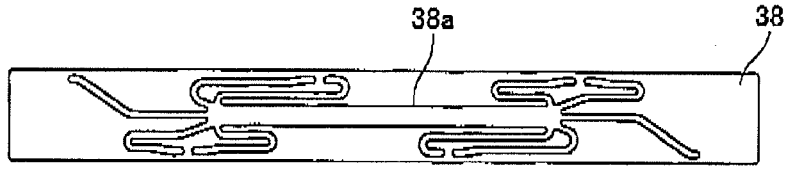
Figure 5E:
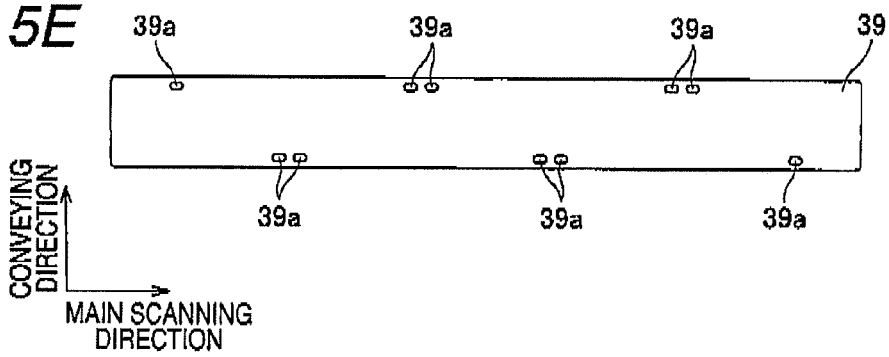

Here, a description will be given of the reservoir unit 3, further referring to FIGS. 5A through 5E which are plan views of respective members of the reservoir unit 3. Also, FIG. 5A is a plan view of the upper reservoir forming body 30 when being observed from above, FIG. 5B is a plan view thereof when being observed from below, and FIGS. 5C through 5E are plan views of the respective plates 37 through 39 when being observed from above.

The upper reservoir forming body 30 comprises, for example, synthetic resins such as polyethylene terephthalate resin and polypropylene resin. Claw parts 32 that are engaged in openings 37*b* formed in the uppermost layer of plate 37 of the lower reservoir forming body 35 are formed two by two in the vicinity of both ends in the lengthwise direction of the upper reservoir forming body 30 as described later. Therefore, the upper reservoir forming body 30 is fixed on the upper surface of the lower part reservoir forming body 35.

The upper reservoir 31 is formed in the interior of the upper reservoir forming body 30. The upper reservoir 31 is formed from the middle part (hereinafter, simply referred to as "middle part") in the lengthwise direction of the upper reservoir forming body 30 to one end part (the left side end part in FIG. 4 and FIGS. 5A through 5E, hereinafter, simply referred to as "one end"), and the upper reservoir 31 comprises three passages of an inflow passage 32*a*, an outflow passage 32*b* and a connection passage 32*c*. Cylindrical joint portions 33 and 34 that communicate with the end parts of the inflow passage 32*a* and the outflow passage 32*b* in their extension directions and protrude upward are formed on the upper surface in the vicinity of one end part of the upper reservoir forming body 30 so as to be proximate to each other. And, the openings delimited by the upper ends of the joint portions 33 and 34 are made into the ink supply port 42 and the ink ejection port 43. In addition, as shown in FIG. 4 and FIG. 5B, a connection port 31*a* communicating with the downward passage is formed at the middle part of the upper reservoir forming body 30.

The inflow passage 32*a* is formed so as to extend from one end part of the upper reservoir forming body 30 to the vicinity of the middle part thereof at the lower part (hereinafter, simply referred to as "lower part") with respect to the thickness direction (up and down direction) of the upper reservoir forming body 30. The outflow passage 32*b* extends to be slender from one end part of the upper reservoir forming body 30 to the vicinity of the middle part thereof. In further detail, the half at one end part side at the outflow passage 32*b* is formed at the lower part of the upper reservoir forming body 30. On the other hand, the remaining half of the outflow passage 32*b* is formed at the upper part (hereinafter, simply referred to as "upper part") in regard to the thickness direction of the upper reservoir forming body 30, and extends downward in the vicinity of the middle part and joins the inflow passage 32*a*. The connection passage 32*c* is linked with the confluent portion of the inflow passage 32*a* and the outflow passage 32*b* and extends downward to the connection port 31*a* after extending to the middle part at the upper part of the upper reservoir forming body 30.

The half at the middle part side of the inflow passage 32*a* has a roughly parallelogram-shaped form in plan view. In the roughly parallelogram-shaped form of the inflow passage 32*a*, a filter 44 that catches foreign substances of passing ink is disposed roughly at the middle part with respect to the thickness direction thereof. That is, spacing at both sides between which the filter 44 is placed is a filter chamber. That is, the filter chamber of the inflow passage 32*a* is divided into an upstream portion at the ink supply port 42 side and a downstream portion at the connection passage 32*c* side by the filter 44. And, the outflow passage 32*b* communicates with the distal end of the upstream portion of the filter chamber of the inflow passage 32*a*. Here, air bubbles are likely to remain in the filter chamber, particularly in the upstream portion thereof. In the first exemplary embodiment, since the outflow passage 32*b* is connected to the upstream portion of the filter chamber where air bubbles are likely to remain, it is possible to reliably eject the remaining air bubbles.

Also, the film 45 that is welded to the underside of the upper reservoir forming body 30 and has flexibility becomes a passage wall of the underside of the inflow passage 32*a*. In other words, the inflow passage 32*a* is in contact with the atmospheric air via the film 45. Here, slight clearance is formed between the underside of the upper reservoir forming body 30 and the upper surface of the lower reservoir forming body 35. Therefore, when the interior of the upper reservoir 31 is subjected to a radial change in pressure, the change in pressure can be absorbed by free deformation of the film 45. That is, the film 45 functions as a damper. Further, the film 46 welded to the underside of the upper reservoir forming body 30 becomes a passage wall of the underside of the outflow passage 32*b*. In addition, a film 47 and a film 48, which are welded to the upper surface of the upper reservoir forming body 30, become passage walls of the upper surface of the outflow passage 32*b* and the connection passage 32*c*, respectively. Any one of the films 46, 47 and 48 contributes to absorption of a change in pressure similar to the film 45.

The plates 37 through 39 comprise a metallic plate such as, for example, stainless steel, etc. As shown in FIG. 4, in the interior of the lower reservoir forming body 35 including plates 37 through 39 which are laminated to each other, the lower reservoir 36 is formed which is made into a passage to distribute ink in the upper reservoir 31 to the passage unit 5.

As shown in FIGS. 5A through 5E, a through-hole (drop passage 37*a*) communicating with the upper reservoir 31 via the connection port 31*a* is formed in the plate 37 of the uppermost layer of the plates 37 through 39. Further, openings 37*b* that are engaged with the claw portions 32 formed at the upper reservoir forming body 30 described above are formed two by two in the vicinity of both the end parts in the lengthwise direction of the plate 37. Further, ten through-holes (communication passages 39*a*) communicating with the ink inflow port 5*a* (Refer to FIG. 7) formed in the passage unit 5 as described later are formed in the plate 39 of the lowermost layer. A hole (connection passage 38*a*) for communicating with the drop passage 37*a* and for allowing the ten communication passages 39*a* to communicate with each other is formed in the plate 38 located between the plate 37 and the plate 39. The lower reservoir 36 (Refer to FIG. 4) is formed of the drop passage 37*a*, the connection passage 38*a* and the communication passage 39*a*.

The length in the lengthwise direction of the plate 37 of the uppermost layer is longer than the length in the lengthwise direction of the other plates 38 and 39. Therefore, both ends of the plate 37 protrude from both ends of the plates 38 and 39 in a state where the plates 37 through 39 are laminated to each other and the lower reservoir forming body 35 is constructed. A through-hole 37*c* is formed in the protruded portions thereof, respectively. The through-holes 37*c* are used when mounting the ink jet head 100 on the frame 7 of the printer as shown in FIG. 3.

As described above, a reservoir 41 including the upper reservoir 31 formed in the upper reservoir forming body 30 and the lower reservoir 36 formed in the lower reservoir forming body 35 is formed in the reservoir unit 3. The reservoir unit 3 is a multi-functional member which includes a filtering function to filter ink supplied from the outside and a damper function to absorb a change in pressure in the ink in addition to a function for supplying ink to the passage unit 5.

Here, a detailed description will be given for a supply valve mechanism 70 with reference to FIG. 2 and FIG. 6 that is a partially enlarged sectional view showing a vicinity of the ink supply port 42 of the ink jet head 100. The supply valve mechanism 70 is attached to the ink supply port 42 delimited by the upper end of the joint portion 33 communicating with the inflow passage 32*a* among the joint portions 33 and 34 formed to be proximate to each other as described above. The supply valve mechanism 70 includes a communication member 71, a fixing member 73, a movable member 76 and a pressing spring 79.

The communication member 71 is a member, in which a communication passage 72 extends from the interior of the joint portion 33 to the exterior thereof via the ink supply port 42, having the outer diameter at the lower end thereof being smaller than the inner diameter of the joint portion 33, and the outer diameter at the upper end side being larger than the inner diameter of the joint portion 33. The communication member 71 is fixed by a fixing member 73 at the joint portion 33 in a state where the lower end side thereof is inserted into the joint portion 33 and the upper end side thereof protrudes from the joint portion 33. The fixing member 73 is a cylindrical member that comprises a major-diameter portion 74 having a slightly larger inner diameter than the outer diameter of the joint portion 33, a minor diameter portion 75 having a smaller inner diameter than the outer diameter of the joint portion 33, and a connection portion 73*a* for connecting the major diameter portion 74 and the minor diameter portion 75 with each other. The fixing member 73 is attached to the upper reservoir forming body 30 so that the joint portion 33 is inserted into the major diameter portion 74 with the communication member 71 placed therebetween.

Figure 6:
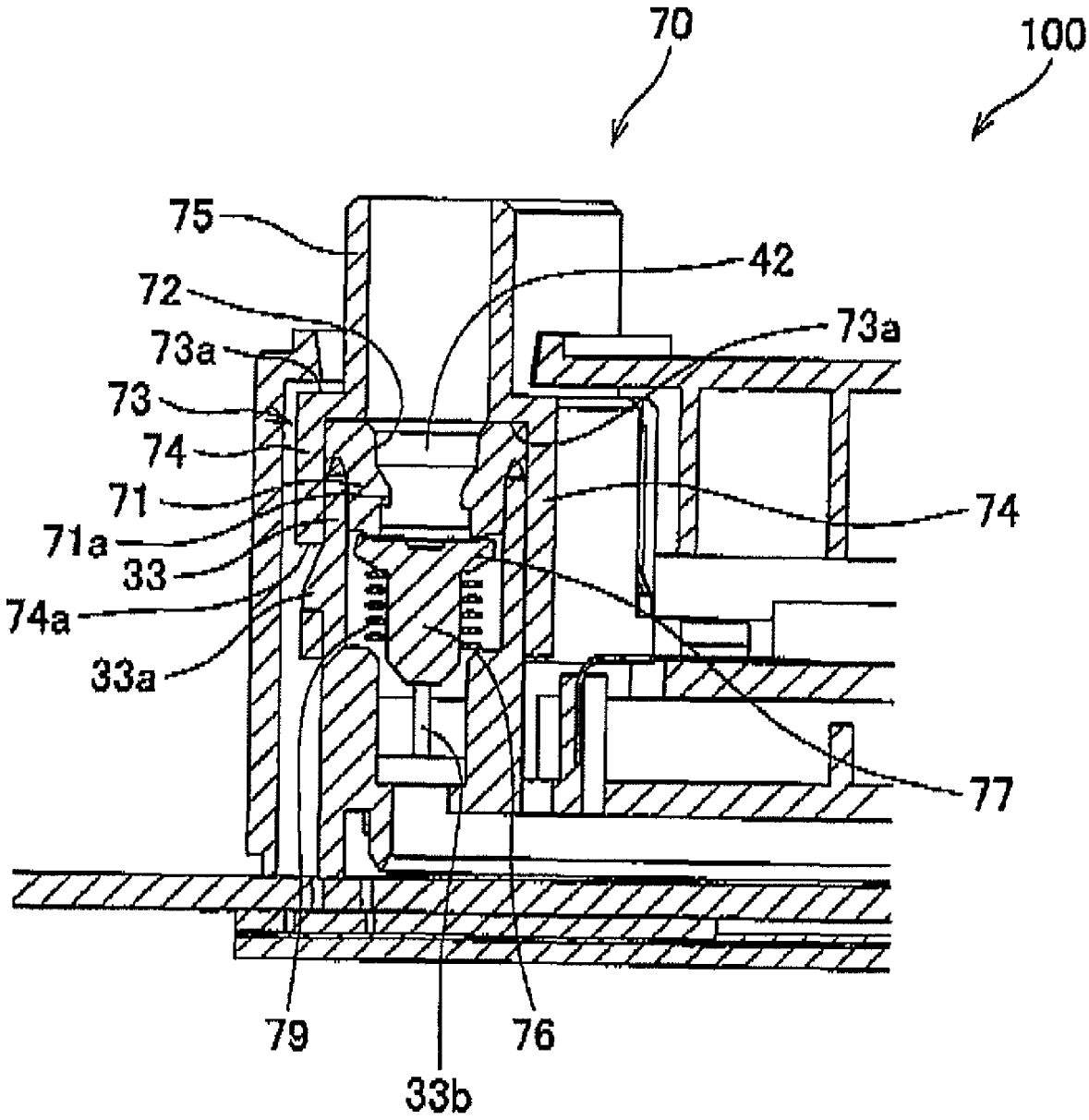
FIG. 6 is a partially enlarged sectional view showing the vicinity of an ink supply port of a main body block of the ink jet head shown in FIG. 2.

As shown in FIG. 6, the portion protruding from the joint portion 33 of the communication member 71 is brought into such a state where the protruded portion is placed between the upper end of the joint portion 33 and the connection portion 73*a* of the fixing member 73. Here, a projection 33*a* is formed on the outer circumferential surface of the joint portion 33. Further, an opening 74*a* engaged with the projection 33*a* is formed at the major diameter portion 74 of the fixing member 73. Therefore, by the projection 33*a* of the joint portion 33 being engaged in the opening 74*a* of the fixing member 73, the fixing member 73 can be fixed at the upper reservoir forming body 30. Accordingly, the communication member 71 can be fixed at the joint portion 33 by the fixed fixing member 73.

Here, as shown in FIG. 6, the inner diameter of the downward portion of the joint portion 33 is made smaller than the inner diameter of the upward portion. Also, a guide pin 33*b* extending in the extension direction of the joint portion 33 is disposed in the joint portion 33. The movable member 76 is a columnar member having a smaller outer diameter than the inner diameter of the downward portion of the joint portion 33, and has a collar portion 77 formed at one end thereof, which has a larger diameter than the inner diameter of the downward portion of the joint portion 33 and the inner diameter at the lower end of the communication member 71. The movable member 76 is disposed in the joint portion 33 so that the collar portion 77 comes upward. Further, a hole is formed in the movable member 76 along the axis of the extension direction of the movable member 76, and the guide pin 33*b* is inserted into the hole. In addition, the hole extends almost the entire length of the movable member 76 with the collar portion 77 remaining. Therefore, the movable member 76 is made movable up and down in the extension direction of the joint portion 33 along the guide pin 33*b*. In further detail, the movable member 76 will take a sealing position where the collar portion 77 is brought into contact with the lower end of the communication member 71 and seals the communication passage 72, and an open position where the collar portion 77 is separated from the communication member 71 and opens the communication passage 72. That is, when the movable member 76 is located at the sealing position, the ink supply port 42 is sealed by the collar portion 77, and when it is located at the opening position, the ink supply port 42 is opened.

The pressing spring 79 is disposed at the upward portion, the inner diameter of which is comparatively large, in the joint portion 33, and presses the collar portion 77 of the movable member 76 to the sealing position from downward to upward. Therefore, the supply valve mechanism 70 can keep the ink supply port 42 at the sealing position unless the movable member 76 is pressed in the direction opposite to the pressing direction of the pressing spring 79.

The ejection valve mechanism 80 includes a communication member 81, a fixing member 83, a movable member 86 and a pressing spring 89 as in the supply valve mechanism 70, and is attached to the ink ejection port 43 delimited by the upper end of the joint portion 34. Here, since the ejection valve mechanism is similar to the supply valve mechanism, a detailed description of the ejection valve mechanism 80 is omitted. Also, as shown in FIG. 2, in the first exemplary embodiment, the communication member 71 of the supply valve mechanism 70 and the communication member 81 of the ejection valve mechanism 80 are formed as an integral member. In further detail, the upper end side portion protruding from the joint portion 33 of the communication member 71 is lined with the upper end side portion protruding from the joint portion 34 of the communication member 81. Similarly, the fixing member 73 of the supply valve mechanism 70 and the fixing member 83 of the ejection valve mechanism 80 are also formed as an integral member. In further detail, the major diameter portion 74 of the fixing member 73 and the major diameter portion 84 of the fixing member 83 are linked with each other.

Figure 8:
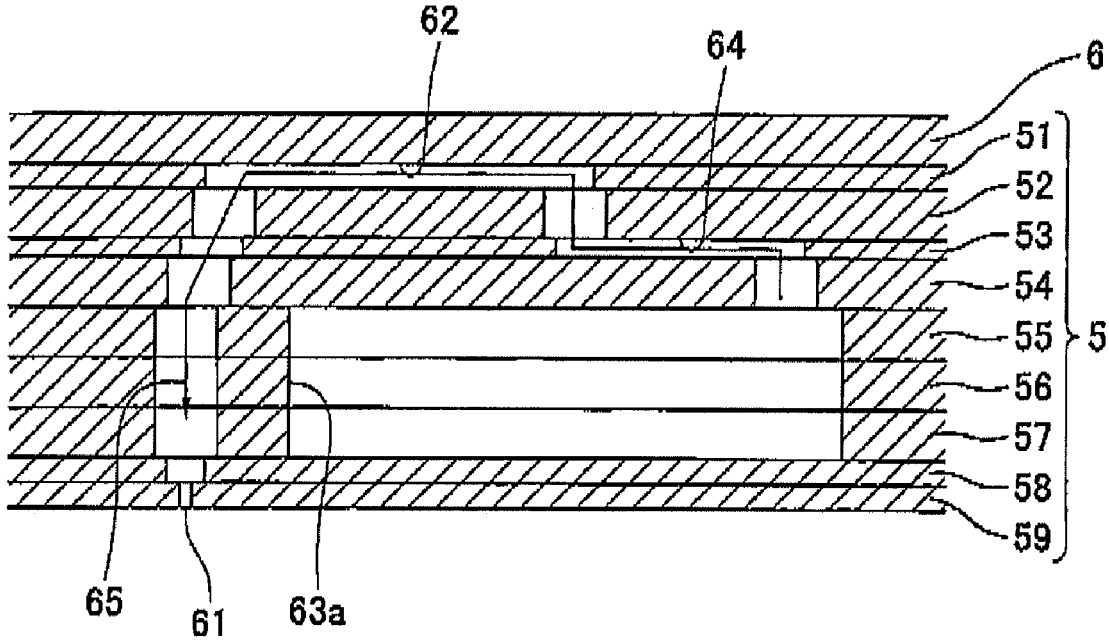
FIG. 8 is a partial sectional view of the passage unit shown in FIG. 7.

Next, a detailed description will be given of the passage unit 5 using FIG. 7 and FIG. 8. FIG. 7 is a plan view showing the passage unit 5, and FIG. 8 is a partial sectional view of the passage unit 5. The passage unit 5 has a rectangular shape in plan view, four actuator units 6 having a trapezoidal shape are disposed on the upper surface of the passage unit 5 in a chessboard pattern.

An ink discharge area includes a number of nozzles 61 formed therein which are arranged at a portion corresponding to the actuator unit 6 on the underside of the passage unit 6. A number of pressure chambers 62 communicating respectively with the nozzles 61 are formed on the upper surface of the passage unit 5. And, one actuator unit 6 is disposed so as to enclose a number of pressure chambers 62.

A manifold passage 63 communicating with the ink inflow port 5*a* formed on the upper surface of the passage unit 5, a sub-manifold passage 63*a* bifurcated from the manifold passage 63, and, as shown in FIG. 8, individual ink passages 65 formed from the outlet of the sub-manifold passage 63 to the nozzles 61 via the pressure chamber 62 are formed in the interior of the passage unit 5. Therefore, ink from the reservoir unit 3 is supplied to the manifold passage 63 via the ink inflow port 5*a*, and is further distributed to the respective pressure chambers 62. Accordingly, as pressure is selectively given to the pressure chambers 62 by the actuator unit 63, the ink pressure in the pressure chambers 62 is increased, wherein ink is discharged through the nozzles 61 communicating with the pressure chamber 62.

As shown in FIG. 8, the passage unit 5 has a laminated structure in which a cavity plate 51, a base plate 52, an aperture plate 53, a supply plate 54, manifold plates 55, 56, 57, a cover plate 58 and a nozzle plate 59 are laminated in order from top to bottom. That is, the ink discharge area is formed below the underside of the nozzle plate 59. Also, the respective plates 51 through 59 are made of a metallic plate such as stainless steel, etc.

The plates 51 through 59 are laminated with their positions matched to each other so that the manifold passage 63 and the sub-manifold passage 63*a* are formed, and, as shown in FIG. 8, a number of individual ink passages 65 are formed from the outlet of the sub-manifold passage 63*a* to the nozzles 61 via the aperture 64 and the pressure chambers 62.

Figure 9A:
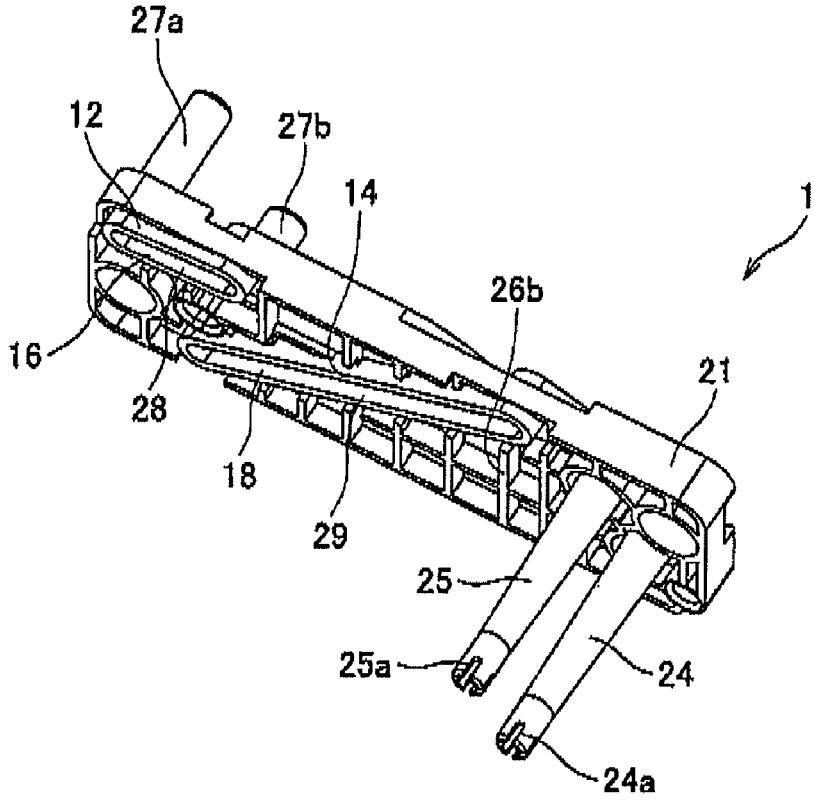
FIGS. 9A and 9B are perspective views showing an attachment according to a first exemplary embodiment of the invention.
Figure 9B:
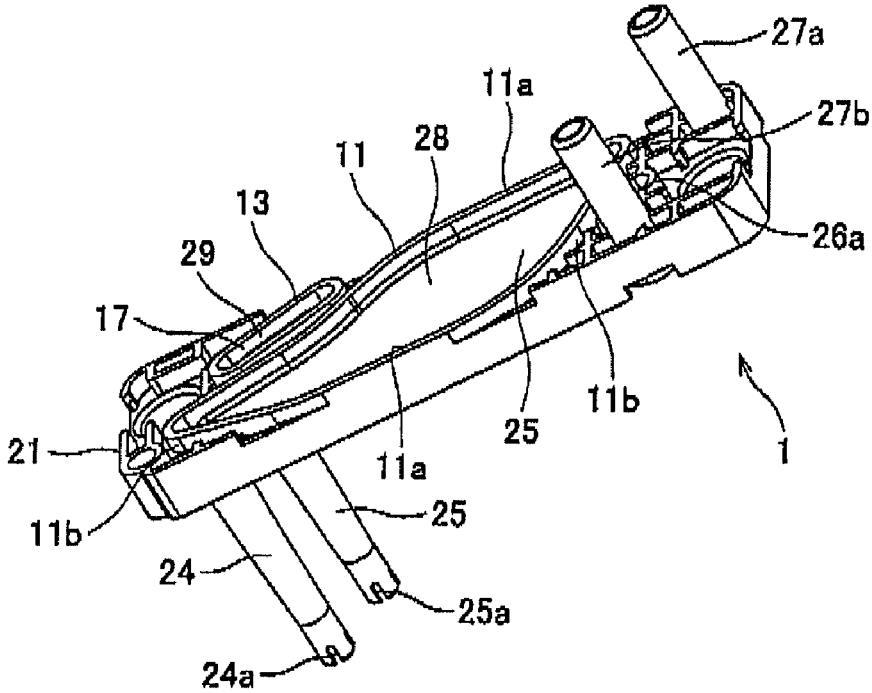
Figure 10A:
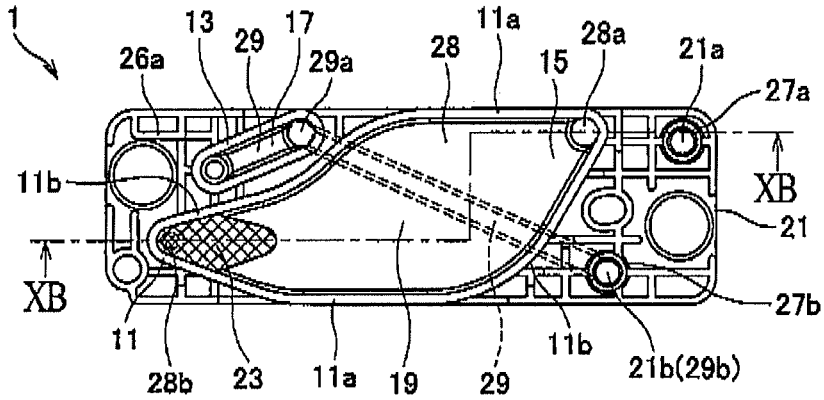
FIGS. 10A and 10C are plan views and FIG. 10B is a sectional view, of the attachment of FIG. 9.
Figure 10B:
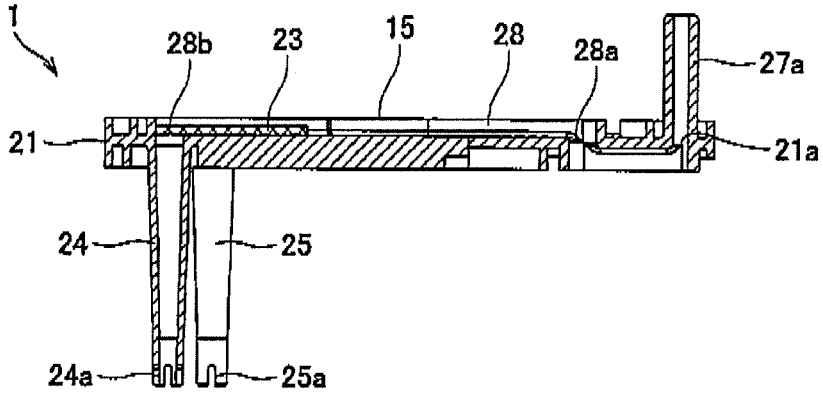
Figure 10C:
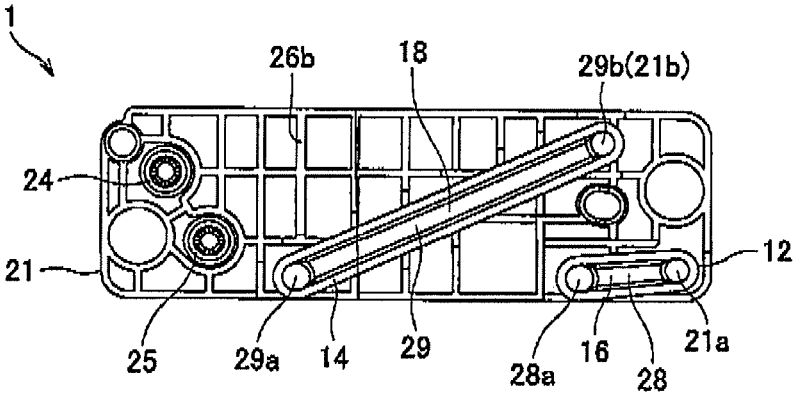

Subsequently, further referring to FIGS. 9A and 9B and FIGS. 10A through 10C, a description will be given of the attachment 1. FIG. 9A is a perspective view showing the attachment 1 when being observed diagonally from below, and FIG. 9B is a perspective view showing the attachment 1 when being observed diagonally from above. FIG. 10A is an upper plan view of the attachment 1, FIG. 10B is a sectional view taken along the line XB-XB of FIG. 10A, and FIG. 10C is a bottom plan view of the attachment 1.

The attachment 1 includes a plate-shaped main body portion 21 having a rectangular outer shape in plan view, a supply valve opening portion 24 and an ejection valve opening portion 25, both of which are provided so as to protrude from the underside of the main body portion 21 and are roughly cylindrical. As shown in FIG. 1 and FIG. 2, the upper surface of the main body portion 21 is covered by the cover 1*a*. Also, with respect to the supply valve opening portion 24 and the ejection valve opening portion 25, the protruding lengths thereof from the underside of the main body portion 21 are equal to each other, as shown in FIG. 10B.

A supply passage 28 through which ink sent to the ink supply port 42 of the reservoir unit 3 passes, and an ejection passage 29 through which ink ejected from the ink ejection port 43 passes are formed in the main body portion 21. The interior of the supply valve opening portion 24 is connected to the supply passage 28. On the other hand, the interior of the ejection valve opening portion 25 is connected to the ejection passage 29. In addition, an ink inlet 21*a* connected to the supply passage 28, and an ink outlet 21*b* connected to the ejection passage 29 are formed in the main body portion 21. Either of ink inlet 21*a* or the ink outlet 21*b* communicates with upward spacing. That is, the supply passage 28 extends from the portion, to which the supply valve opening portion 24 is connected, to the ink inlet 21*a* in the main body portion 21. On the other hand, the ejection passage 29 extends from the portion to which the ejection valve opening portion 25 is connected, to the ink outlet 21*b*.

Cylindrical joint portions 27*a* and 27*b* protruding upward are formed on the upper surface of the main body portion 21. The joint portion 27*a* communicates with the ink inlet 21*a*, and the joint portion 27*b* communicates with the ink outlet 21*b*. As shown in FIG. 3, an end portion of a supply tube 4*a* connected to the ink tank 4 is connected to the joint portion 27*a*. On the other hand, an end portion of the ejection tube 4*b* connected to the ink tank 4 is connected to the joint portion 27*b*.

The supply valve opening portion 24 and the ejection valve opening portion 25 are connected to the main body portion 21 so as to be separated from each other in the width direction of the main body portion 21 in the vicinity of one end portion in the lengthwise direction of the main body portion 21. In addition, the ink inlet 21*a* and the ink outlet 21*b* are formed at a position at which both are separated from each other in the width direction of the main body portion 21, in the vicinity of the other end portion at the side opposite to the side where the supply valve opening portion 24 and the ejection valve opening portion 25 of the main body portion 21 are connected. In further detail, the ink inlet 21*a* is formed at the other end side opposite to one end side in the width direction of the main body portion 21 to which the supply valve opening portion 24 is connected, and the ink outlet 21*b* is formed at one end side opposite to the other end side in the width direction of the main body portion 21 to which the ejection valve opening portion 25 is connected.

Two annular projections 11 and 13 protruding in the direction orthogonal to the upper surface of the main body portion 21 are formed on the upper surface thereof. As shown in FIG. 10A, annular projection 11 may surround an area of the upper surface having an elongated oval shape, and annular projection 13 may surround another area of the upper surface having a substantially parallelogram shape. On the other hand, two annular projections 12 and 14 protruding in the direction orthogonal to the lower surface of the main body portion 21 are formed on the lower surface thereof. As shown in FIG. 10C, annular projection 12 may surround an area of the lower surface having an elongated oval shape, and annular projection 14 may surround another area of the lower surface having an elongated oval shape. Further, films 15 through 18, which have flexibility, are welded to the distal ends of the annular projections 11 through 14.

The annular projection 11 and the film 15 welded thereto, and the annular projection 12 and the film 16 welded thereto delimit the supply passage 28. In the following description, the portion delimited by the annular projection 11 of the supply passage 28 and the film 15 is called an "upper supply passage." On the other hand, the annular projection 13, the film 17 welded thereto, the annular projection 14 and the film 18 welded thereto delimit the ejection passage 29. In the following description, the portion delimited by the annular projection 14 and the film 18 is called a "lower ejection passage."

That is, since one side of the films 15 through 18 is in contact with the atmosphere, and the other side thereof is in contact with ink, the atmosphere and ink are separated from each other. The films 15 and 16 function as a damper that absorbs a change in pressure when a radical change in pressure occurs in the supply passage 28. On the other hand, the films 17 and 18 function as a damper that absorbs a change in pressure when a radial change in pressure occurs in the ejection passage 29.

The annular projection 11 that delimits a part of the supply passage 28 is formed in a range from the portion to which the supply valve opening portion 24 is connected to the vicinity of the ink inlet 21*a* in the plan view on the upper surface of the main body portion 21. Further, the annular projection 12 extends from the vicinity of the ink inlet 21*a* to the portion, in which the ink inlet 21*a* is formed, in plan view on the underside of the main body portion 21. As shown in FIGS. 10A through 10C, the annular projection 12 is formed along the end edge portion of the main body portion 21. The annular projection 11 and the annular projection 12 are formed so that the areas surrounded thereby are stacked in the vicinity of the ink inlet 21*a* in plan view. In further detail, as shown in FIGS. 10A through 10C, with respect to the area surrounded by the annular projection 11, the tapered end portion thereof is stacked on the end portion of the area surrounded by the annular projection 12. Spacing surrounded by the annular projection 12 is linked to the ink inlet 21*a*. An inflow port 28*a* linked to the spacing surrounded by the annular projection 12 and an outflow port 28*b* linked to the interior of the supply valve opening portion 24 are formed in the area surrounded by the annular projection 11 on the upper surface of the main body portion 21. In the first exemplary embodiment, a majority of the upper surface of the main body portion 21 is occupied by the area surrounded by the annular projection 11.

Also, the annular projection 11 includes two opposite portions 11*a*, 11*a*, each of which extends along an end edge portion in the width direction of the main body portion 21, respectively. That is, a widening portion 19 widened to both ends in the width direction of the main body portion 21 by the opposite portions 11*a* is formed at the upper supply passage. The portion of the annular projection 11, which excludes the opposite portions 11*a*, is a linkage portion 11*b*. That is, a pair of two opposite portions 11*a* are linked with each other by the linkage portion 11*b*. The annular projection 11 thus comprises the pair of opposite portions 11*a* and a pair of linkage portions 11*b*. Further, the passage width of the upper supply passage is tapered from the widening portion 19 toward the outflow port 28*b*.

The annular projection 13 that delimits a part of the ejection passage 29 extends diagonally in the lengthwise direction of the main body portion from the portion to which the ejection valve opening portion 25 is connected in plan view, toward the other end portion in the width direction of the main body portion 21 on the upper surface of the main body portion 21. The annular projection 14 extends in a straight manner from the end portion at the opposite side of the portion to which the ejection valve opening portion 25 of the annular projection 13 is connected in plan view, to the position where the ink outlet 21*b* is formed. That is, the area surrounded by the annular projection 13 and the area surrounded by the annular projection 14 overlap each other at the ends thereof in plan view. Space surrounded by the annular projection 13 is linked to the interior of the ejection valve opening portion 25. The inflow port 29*a* linked to the space surrounded by the annular projection 13 and the outflow port 29*b* linked to the ink outlet 21*b* are formed in the area surrounded by the annular projection 14 on the underside of the main body portion 21.

As shown in FIG. 10A, a segment connecting the inflow port 28*a* of the upper supply passage to the outflow port 28*b* thereof and a segment connecting the inflow port 29*a* of the lower ejection passage (shown by a broken line in FIG. 10A) to the outflow port 29*b* thereof cross each other in plan view. In further detail, the lower ejection passage crosses the linkage portion 11*b* at the annular projection 11 that delimits the upper supply passage in plan view. In other words, the lower ejection passage overlaps the widening portion 19 of the upper supply passage in the up and down direction.

Furthermore, a filter 23 that catches foreign substances in passing ink is arranged in the outflow port 28*b* of the upper supply passage. That is, a filter chamber that is divided into an upstream portion formed in the main body portion 21 and a downstream portion formed in the supply valve opening portion 24 by the filter 23 are formed in the interior of the attachment 1. With such a configuration, the upper supply passage is concurrently used as a damper chamber and a filter chamber.

Also, a rib 26*a* is formed at the area, excluding the area having the annular projections 11 and 13 formed therein, on the upper surface of the main body portion 21. On the other hand, a rib 26*b* is formed at the area, excluding the area having the annular projections 12 and 14 formed therein, on the underside of the main body portion 21. Either one of the ribs 26*a* or 26*b* is formed to be roughly like a lattice. With the ribs 26*a* and 26*b*, the rigidity of the attachment 1 can be increased, and deformation thereof can be prevented. Further, no rib 26*a* exists in the widening portion surrounded by the annular projection 11. However, the annular projection 14 of the ejection passage 29 is arranged on the underside so as to cross the widening portion on the upper surface in plan view. For this reason, it is possible to prevent the rigidity of the attachment 1 from being lowered due to formation of the passage, particularly, formation of the widening portion.

The supply valve opening portion 24 and the ejection valve opening portion 25 are tapered. A plurality of slits 24*a*, 25*a* are formed at the distal end of the supply valve opening portion 24 and the ejection valve opening portion 25, respectively. When the attachment 1 is mounted at the ink jet head 100, the supply valve opening portion 24 presses the movable member 76 of the supply valve mechanism 70 downward opposite to the pressing direction of the pressing spring 79. The movable member 76 is moved to the opening position, and the supply valve mechanism 70 is caused to open. On the other hand, the ejection valve opening portion 25 presses the moving member 86 of the ejection valve mechanism 80 downward opposite to the pressing direction of the pressing spring 89. The moving member 86 is moved to the opening portion, and the ejection valve mechanism 80 is caused to open. At this time, the supply passage 28 of the attachment 1 communicates with the inflow passage 32*a* of the upper reservoir forming body 30 via the slit 24*a*, and the ejection passage 29 communicates with the outflow passage 32*b* via the slit 24*b*.

Figure 11A:
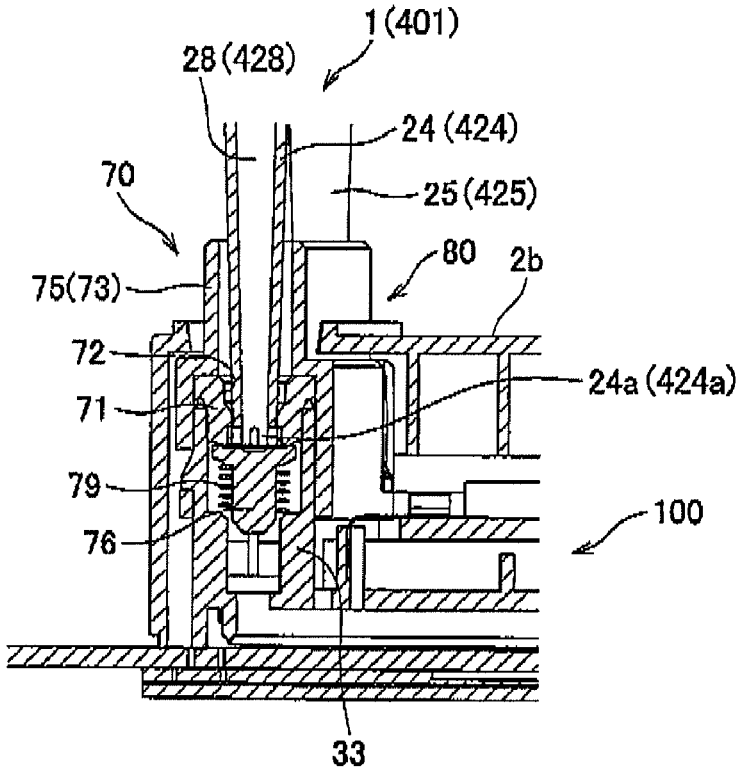
FIGS. 11A and 11B are views describing opening and closing operations of a supply valve mechanism of the ink jet head of FIG. 2.
Figure 11B:
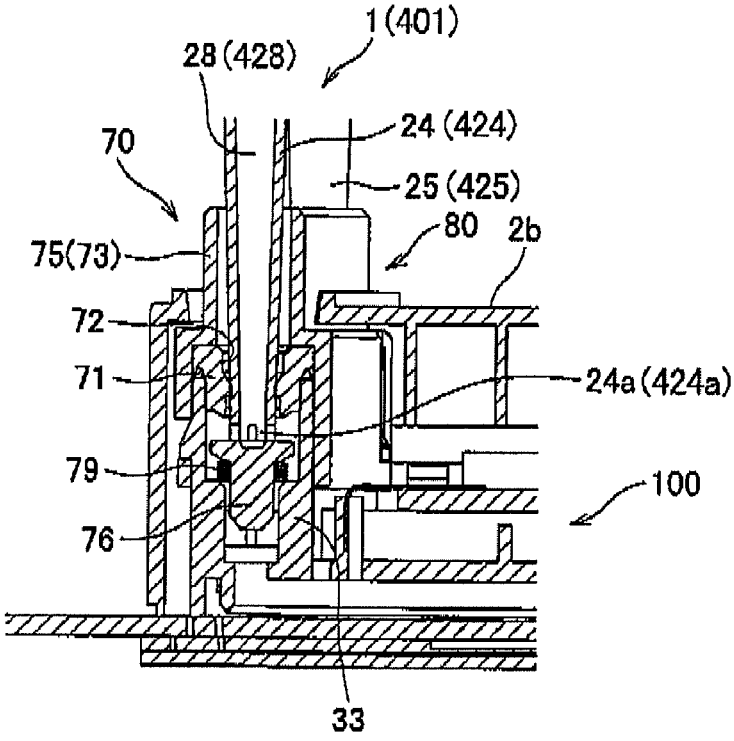

Here, referring to FIG. 11A and FIG. 11B, a description will be given of the opening and closing actions of the supply valve mechanism 70 by the supply valve opening portion 24. FIG. 11A shows a state before the supply valve mechanism 70 is closed, and FIG. 11B shows a state where the supply valve mechanism 70 is opened. Also, since opening and closing actions of the ejection valve mechanism 80 are similar to those of the supply valve mechanism 70, the description thereof is omitted here.

First, as shown in FIG. 11A, when the attachment 1 is mounted at the ink jet head 100, the supply valve opening portion 24 communicates with the interior of the minor-diameter portion 75 of the fixing member 73 in the supply valve mechanism 70 and with the communication passage 72 of the communication member 71. At this time, the distal end of the supply valve opening portion 24 is brought into contact with the movable member 76 of the supply valve mechanism 70. After that, by pressing the attachment 1 downward, the distal end of the supply valve mechanism 24 presses the movable member 76 of the supply valve mechanism 70 downward opposite to the pressing direction of the pressing spring 79. Therefore, the movable member 76 moves from the closed sealing position shown in FIG. 11A to the opening position shown in FIG. 11B, wherein the supply valve mechanism 70 is brought into an open state. That is, ink in the supply passage 28 of the attachment 1 is caused to flow from the slit 24*a* at the distal end of the supply valve opening portion 24 into the joint portion 33.

Here, as shown in FIG. 6, an annular projection 71*a* swelled inwardly from the inner wall at an intermediate part of the communication passage 72 is formed at the communication member 71. The annular projection 71*a* is brought into contact with the outer circumferential surface of the supply valve opening portion 24 at the point of time when the above-described distal end of the supply valve opening portion 24 is brought into contact with the movable member 76. The communication member 71 is made of a resin-made flexible material such as rubber, and is brought into contact with the supply valve opening portion 24 in a watertight seal. Even if the supply valve opening portion 24 is further pressed, and ink provisionally flows reversely through a clearance between the communication member 71 and the movable member 76, there is no case where ink leaks outside.

As described above, the attachment 1 according to the first exemplary embodiment is such that a part of the supply passage 28 comprises an annular projection 11 formed on the upper surface of the plate-shaped main body portion 21 and the film 15 welded to the upper end of the annular projection 11. A part of the ejection passage 29 crosses the area opposed to the area surrounded by the annular projection 11 in plan view on the underside of the main body portion 21. Therefore, it is possible to make the size of the main body portion 21 in plan view smaller in comparison with a case where the supply passage 28 and the ejection passage 29 are formed so as not to overlap each other in plan view. Also, it is possible to increase the rigidity of the portion where the annular projection 11 of the main body portion 21 is formed by the ejection passage 29. Accordingly, the attachment 1 can be prevented from being deformed, and it is possible to prevent ink from leaking at the connection portion with the ink jet head 100.

In addition, in the attachment 1 according to the first exemplary embodiment, the segment connecting the inflow port 28*a* of the upper supply passage to the outflow port 28*b* thereof and the segment connecting the inflow port 29*a* of the lower ejection passage to the outflow port 29*b* thereof cross each other in plan view. Therefore, well-balanced rigidity can be created in the main body portion 21.

Further, in the attachment 1 according to the first exemplary embodiment, the upper supply passage is such that the opposite portion 11*a* is formed from the inflow port 28*a* and the upper supply passage is tapered to and is caused to communicate with the outflow port 28*b* via the widening portion 19 the passage of which is widened. Also, the lower ejection passage is formed so as to cross the linkage portion 11*b* that links a pair of opposite portions 19 at the annular projection 11 in plan view, respectively. Therefore, the upper supply passage having the widening portion 11*a* formed thereon can exert a greater damper effect. In addition, simultaneously, it is possible to effectively prevent the rigidity at the widening portion 19 from being lowered by the lower ejection passage crossing the widening portion 19 of the upper supply passage in plan view.

Further, in the attachment 1 according to the first exemplary embodiment, the lower ejection passage is delimited by the annular projection 14 formed on the underside of the main body portion 21 and the film 18 welded to the upper end of the annular projection 14. Additionally, the annular projection 14 straightly extends from the inflow port 29*a* toward the outflow port 29*b*. Accordingly, the lower ejection passage will have a damper effect, wherein a change in pressure of ink can be further prevented. Further, it is possible to more effectively prevent, by the straightly extending annular projection 14, the rigidity in the widening portion 19 of the upper supply passage from being lowered.

In addition, when the attachment 1 is not mounted at the ink jet head 100, the above-mentioned supply valve mechanism 70 is brought into a state in which the ink supply port 42 is blocked. If the attachment 1 is mounted, the ink supply port 42 is brought into an open state. Therefore, in the first exemplary embodiment, it is possible to maintain, by removing the attachment 1, the ink supply port 42 in a blocked state. Additionally, by attaching the attachment 1, can such a state be brought about in which ink can be supplied to the ink jet head 100.

Also, in the first exemplary embodiment, the ink ejection port 43 is formed in the reservoir unit 3, which ejects ink of the reservoir 43 in the interior of the reservoir unit 3, and the ejection passage 29 through which ink ejected from the ink ejection port 43 passes is formed at the attachment 1. Further, the ejection valve mechanism 80 that can take a sealing state and an opening state of the ink ejection port 43 is attached to the ink jet head 100. And, when the attachment 1 is not attached to the ink jet head 100, the ejection valve mechanism 80 is brought into a state in which the ink ejection port 43 is blocked, and in which the attachment 1 is attached to the ink jet head 100, it is brought into a state in which the ink ejection port 43 is opened.

Therefore, in the first exemplary embodiment, air bubbles in the reservoir 41 can be ejected from the ink ejection port 43 along with ink. Also, the ink ejection port 43 can be maintained in a sealing state by removing the attachment 1, and the ink ejection port 43 can be brought into a state in which ink can be ejected, by attaching the attachment 1.

Further, the above-described supply valve mechanism 70 includes a communication member 71 fixed at the reservoir unit 3, in which a communication passage 72 extending from the interior of the reservoir unit 3 to the outside via the ink supply port 42 is formed, a movable member 76 moving between the sealing position for sealing the communication passage 72 and the opening position for opening the communication passage 72, and a pressing spring 79 for pressing the movable member 72 toward the sealing position. On the other hand, the ejection valve mechanism 80 includes the communication member 81, movable member 86 and pressing spring 89 as in the supply valve mechanism 70. And, in a state in which the attachment 1 is attached to the ink jet head 100, the attachment 1 has the supply valve opening portion 24 and the ejection valve opening portion 25, which are inserted into the communication passages 72 and 82, respectively. The supply valve opening portion 24 and the ejection valve opening portion 25 can be moved to the opening position by pressing the movable members 76 and 86 in the direction opposite to the pressing direction by the pressing springs 79 and 89.

Accordingly, in the first exemplary embodiment, it is possible to easily seal and open the ink supply port 42 and the ink ejection port 43 without, for example, requiring any complicated equipment such as actuators and carrying out any troublesome operation.

In addition, in the first exemplary embodiment, the fixing member 73 of the supply valve mechanism 70 and the fixing member 83 of the ejection valve mechanism 80 are formed to be integral. Also, the communication member 71 of the supply valve mechanism 70 and the communication member 81 of the ejection valve mechanism 80 are also formed to be integral. Therefore, the number of components can be reduced.

Modified Versions of the First Exemplary Embodiment

Here, a description will be given of modified versions of the first exemplary embodiment described above. The modified version has a configuration capable of preventing the attachment from being mounted in erroneous directions. There is an example of a configuration (Modified Version 1) capable of only supplying ink, and an example of a configuration (Modified Version 2) capable of circulating ink when being erroneously mounted. The attachment according to the modified versions is such that the configurations of the supply valve opening portion 24 and the ejection valve opening portion 25 in the first exemplary embodiment described above are modified in either case. Other parts of the configuration are similar to those of the first exemplary embodiment described above. Also, components that have a configuration similar to that of the first exemplary embodiment described above are given the same reference numerals.

(First Modified Version)

Figure 12A:
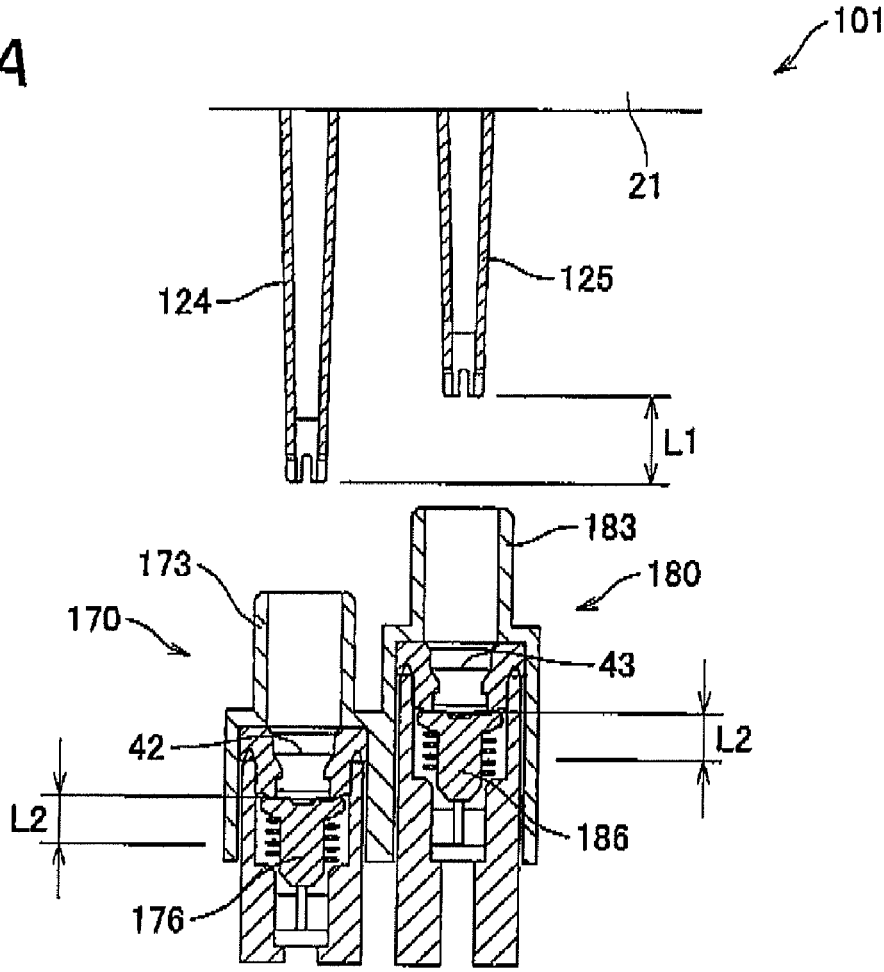
FIGS. 12A and 12B are partial sectional views showing an attachment and an ink jet head according to a first modified version of the first exemplary embodiment of the invention.
Figure 12B:
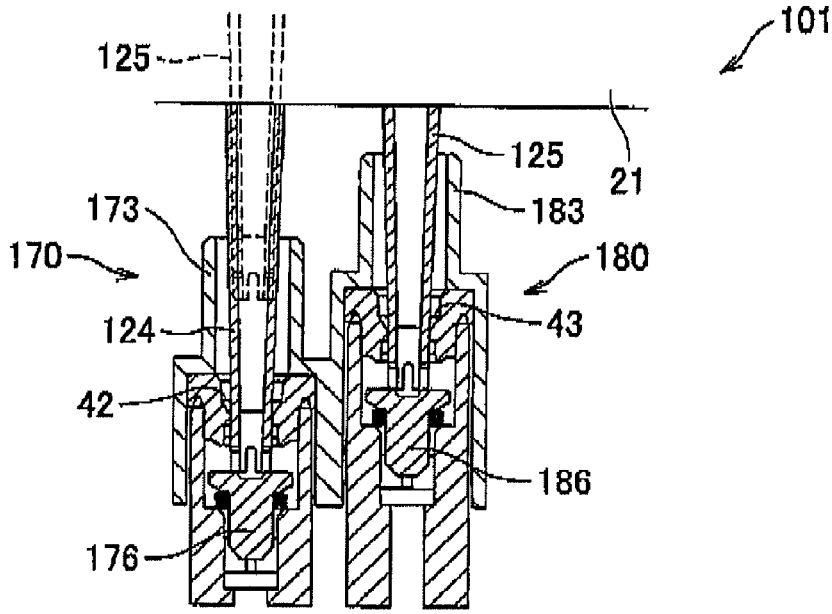

First, referring to FIG. 12A and FIG. 12B, a description will be given for a first modified version of the first exemplary embodiment described above. FIGS. 12A and 12B are sectional views showing the vicinity of portions where a supply valve opening portion 124 and an ejection valve opening portion 125 of the attachment 1 according to the modified version, and a supply valve mechanism 170 and an ejection valve mechanism 180 of the ink jet head are mounted.

As shown in FIGS. 12A and 12B, in the attachment 101 according to the modified version, the length from the underside of the main body portion 21 to the distal end of the supply valve opening portion 124 is longer than the length from the underside of the main body portion 21 to the distal end of the ejection valve opening portion 125. That is, in the modified version, the lengths protruding from the underside of the supply valve opening portion 124 and the ejection valve opening portion 125 differ from each other. In further detail, the difference between the lengths of the supply valve opening portion 124 and the ejection valve opening portion 125, which is shown by L1 in FIG. 12A, is equal to or greater than the interval shown by L2 between the sealing position, and the opening position in which the movable member 176 of the supply valve mechanism 170 and the movable member 186 of the ejection valve mechanism 180 move.

The attachment 101 according to the modified version can be made smaller in size and can be prevented from being deformed as in the attachment 1 according to the first exemplary embodiment described above.

Further, with respect to the attachment 101 according to the modified version, the relative arrangement thereof can be visually and easily recognized based on the difference L1 in the length of the supply valve opening portion 124 and the ejection valve opening portion 125, wherein it is possible to prevent the attachment 101 from being mounted at the ink jet head in erroneous directions. From the viewpoint of further reliably mounting the attachment 101 in the correct direction, the height of the open end of the fixing member 173 at the supply side may be made different from the height thereof at the ejection side. Further, since the length from the underside of the main body portion 21 to the distal end of the supply valve opening portion 124 is longer than the length from the underside of the main body portion 21 to the distal end of the ejection valve opening portion 125, at least ink can be supplied to the ink jet head even if the attachment 101 should be mounted in an erroneous direction. Therefore, printing can be carried out by the ink jet head.

That is, when a mounting direction of the attachment 101 is mistaken, the supply valve opening portion 124 is inserted into the ejection valve mechanism 180, and the ejection valve opening portion 125 is inserted into the supply valve mechanism 170. Hence, the movable member 186 of the ejection valve mechanism 180 reaches the opening position by being pressed by the distal end of the supply valve opening portion 124. Thereby, the ejection valve mechanism 180 is brought into an open state. On the other hand, at this time, the ejection valve opening portion 125 is located at a position in which the distal end thereof is not in contact with the movable member 176 of the supply valve mechanism 170 as shown by a broken line in FIG. 12B. That is, in such a state, the ejection valve opening portion 125 is not able to press the movable member 176.

[Second Modified Version]

Figure 13A:
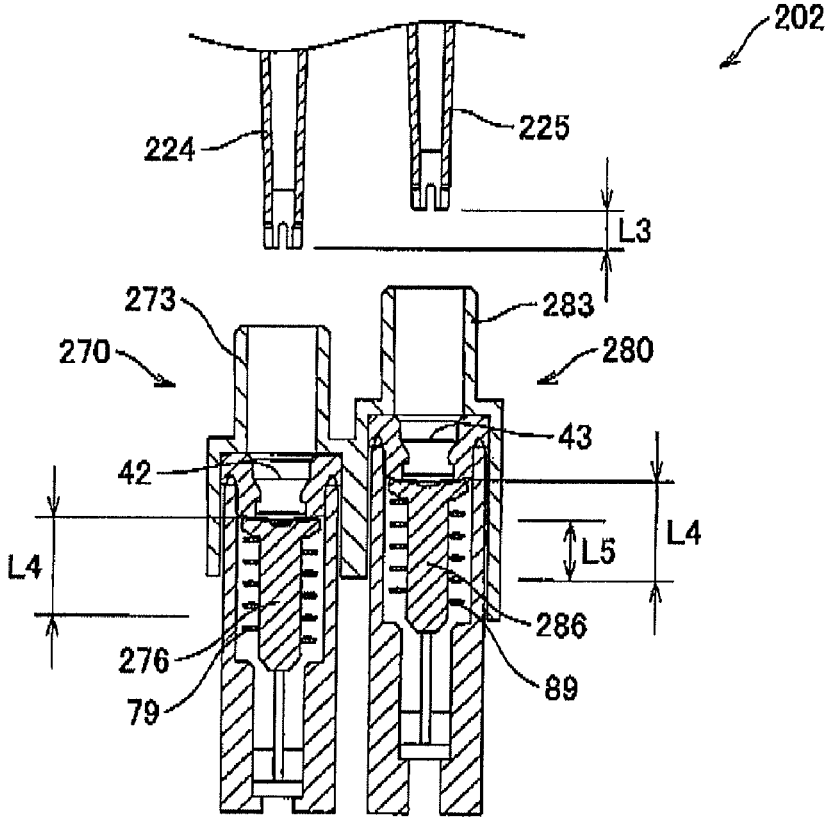
FIGS. 13A and 13B are partial sectional views showing an attachment and an ink jet head according to a second modified version of the first exemplary embodiment.
Figure 13B:
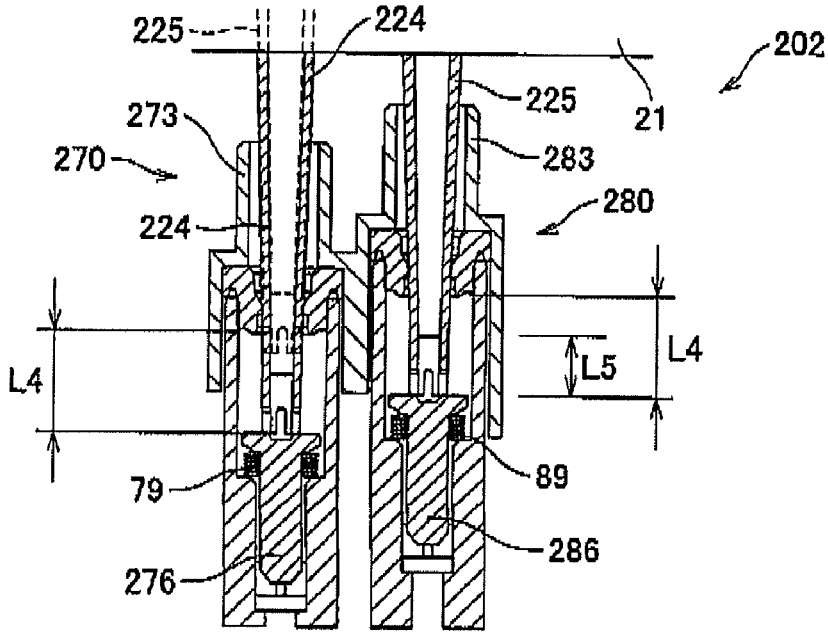

Next, a description will be given for a second modified version of the first exemplary embodiment described above with reference to FIGS. 13A and 13B. FIGS. 13A and 13B are sectional views showing the vicinity of the portion where a supply valve opening portion 224 and an ejection valve opening portion 225 of the attachment 201 according to the second modified version, and a supply valve mechanism 270 and an ejection valve mechanism 280 of the ink jet head are mounted.

As shown in FIGS. 13A and 13B, in the attachment 201 according to the second modified version, the length from the underside of the main body portion 21 to the distal end of the supply valve opening portion 224 is longer than the length from the underside of the main body portion 21 to the distal end of the ejection valve opening portion 225. In further detail, the difference, shown by L3 in FIG. 13A, between the length of the supply valve opening portion 224 and that of the ejection valve opening portion 225 is smaller than the interval shown by L4 between the sealing position, and the opening position in which the movable member 276 of the supply valve mechanism 270 and the movable member 286 of the ejection valve mechanism 280 move. Therefore, as shown in FIG. 13B, when the distal end of the supply valve opening portion 224 reaches the opening position of the supply valve mechanism 270, the distal end of the ejection valve opening portion 225 is located downward of the opening position of the supply valve mechanism 270. Also, L3 is smaller than the interval shown by L5 in FIGS. 13A and 13B, between the opening position of the ejection valve mechanism 280 and the sealing position of the supply valve mechanism 270.

The attachment 201 according to the second modified version can be made smaller in size and can be prevented from being deformed as in the attachment 1 according to the first exemplary embodiment described above.

Further, with respect to the attachment 201 according to the second modified version, the arrangement thereof can be more easily recognized visually by the difference L3 in length between the supply valve opening portion 224 and the ejection valve opening portion 225, wherein it is possible to prevent the attachment 201 from being attached to the ink jet in erroneous directions. From the viewpoint of further reliably mounting the attachment 201 in the correct direction, the height of the opening end upward of the fixing members 273 and 283 at the supply side may be made different from the height thereof at the ejection side. Also, since the difference L3 between the lengths of the supply valve opening portion 224 and the ejection valve opening portion 225 is smaller than the interval L4 between the sealing portion and the opening position in which the movable members 276 and 286 move, and is smaller than the interval L5 between the opening position of the ejection valve mechanism 280 and the sealing position of the supply valve mechanism 270, the supply passage 28 and the ejection passage 29 of the attachment 201 are caused to communicate with the reservoir 41 of the reservoir unit 3, respectively, even if the attachment 201 should be mounted in an erroneous direction.

That is, when the mounting direction of the attachment 201 is mistaken, the supply valve opening portion 224 is inserted into the ejection valve mechanism 280, and the ejection valve opening portion 225 is inserted into the supply valve mechanism 270. Hence, the movable member 286 of the ejection valve mechanism 280 reaches the opening position by being pressed by the distal end of the supply valve opening portion 224. Thereby, the ejection valve mechanism 280 is brought into an open state. That is, a passage connecting the supply passage 28 of the attachment 201 to the reservoir 41 of the reservoir unit 3 is secured. At this time, the distal end of the ejection valve opening portion 225 is located downward of the sealing position of the supply valve mechanism 270 as shown by a broken line in FIG. 13B. That is, at this time, the movable member 276 of the supply valve mechanism 270 is pressed in the direction opposite to the pressing direction of the pressing spring 79 by the ejection valve opening portion 225. Accordingly, in comparison with a case where the attachment 201 is correctly mounted, a passage connecting the ejection passage 29 of the attachment 201 to the reservoir 41 of the reservoir unit 3 can be secured although the passage resistance is increased.

The first exemplary embodiment may be subjected to various additional modifications that are included in the scope of the claims. For example, in the first exemplary embodiment described above, a description has been given of a case where the segment connecting the inflow port 28*a* of the upper supply passage to the outflow port 28*b* and the segment connecting the inflow port 29*a* of the lower ejection passage to the outflow port 29*b* cross each other in plan view. However, it is not necessary that these segments cross each other.

Also, in the first exemplary embodiment described above, a description has been given of a case in which the widening portion 19 is formed in the upper supply passage, and the lower ejection passage crosses the widening portion 19 of the upper supply passage in plan view. The configuration is not limited thereto. The widening portion 19 does not need to be formed in the upper supply passage, and the lower ejection passage does not need to cross the widening portion 19 in plan view.

Further, in the first exemplary embodiment described above, a description has been given of a case in which the lower ejection passage is delimited by the annular projection 14 and the film 18, which extend in a straight manner from the inlet port 29*a* to the outflow port 29*b* on the underside of the main body portion 21. However, the lower ejection passage is not limited thereto. For example, the lower ejection passage may be delimited by the inner wall of a cavity formed in the interior of the main body portion 21 or may extend in a curved manner.

Also, in the first and second modified versions described above, a description has been given for a case in which the length from the underside of the main body portion 21 to the distal end of the supply valve opening portion 124 (224) is longer than the length from the underside of the main body portion 21 to the distal end of the ejection valve opening portion 125 (225). However, alternatively, the length from the underside of the main body portion 21 to the distal end of the ejection valve opening portion 125 (225) may be longer than the length from the underside of the main body portion 21 to the distal end of the supply valve opening portion 124 (224).

Second Exemplary Embodiment

Figure 14A:
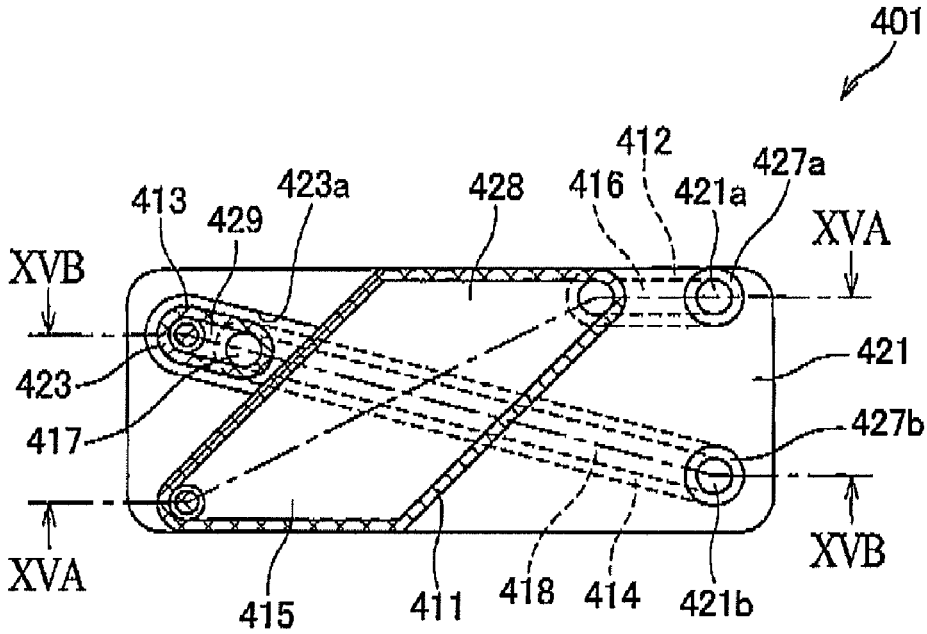
FIGS. 14A and 14B are a surface plan view and a bottom plan view, respectively, showing an attachment according to a second exemplary embodiment of the invention.
Figure 14B:
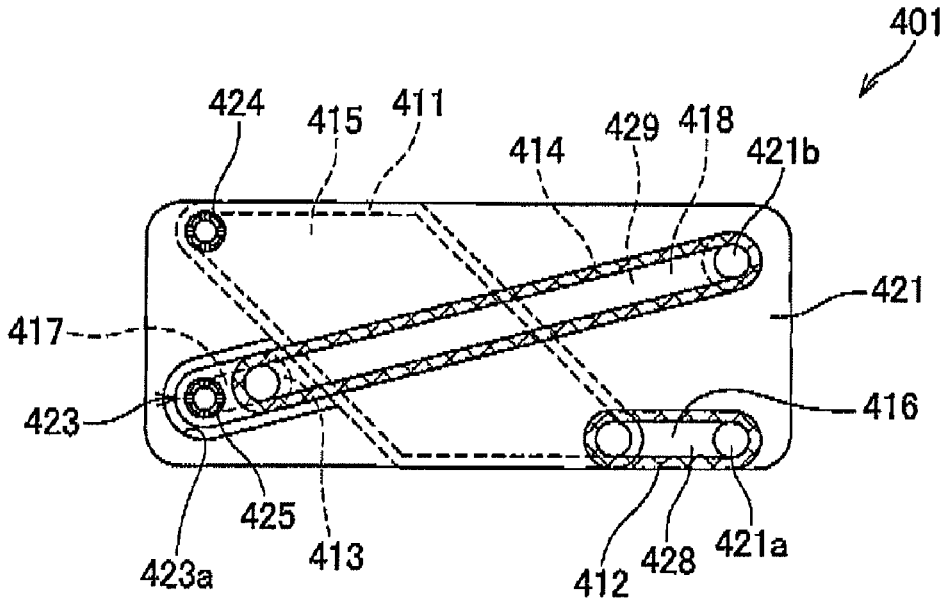
Figure 15A:
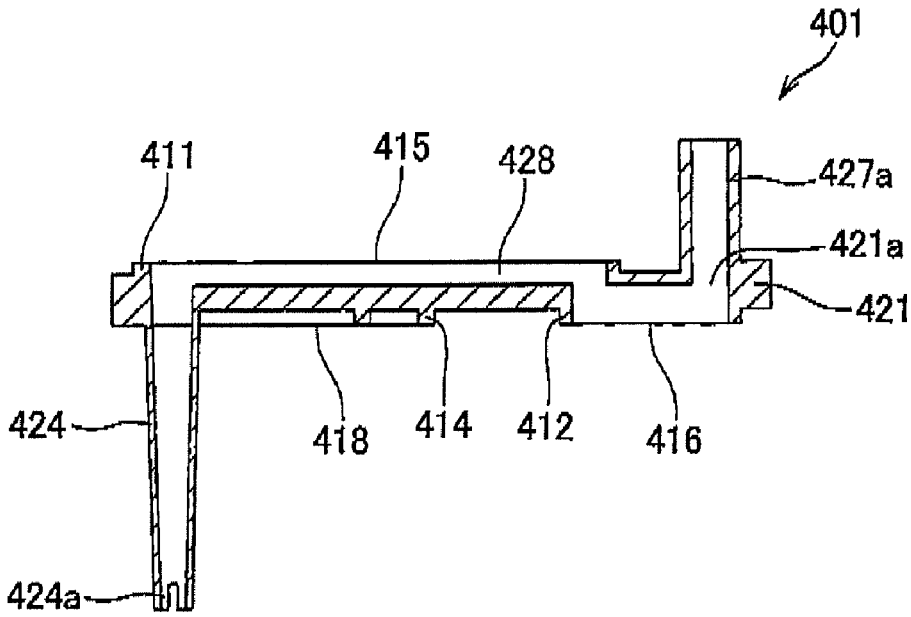
Figure 15B:
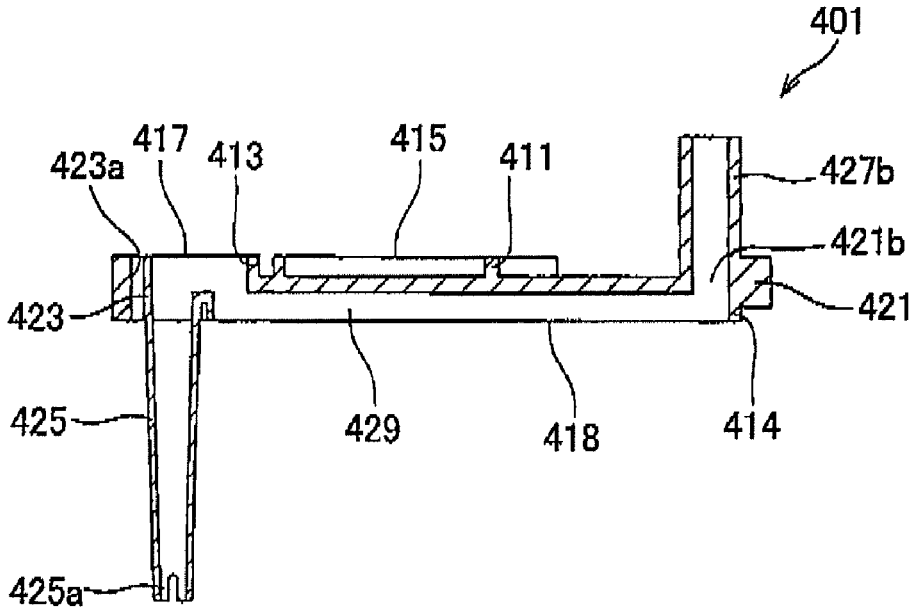

Referring to FIGS. 14A and 14B and FIGS. 15A and 15B, a description will now be given for an attachment according to a second exemplary embodiment of the present invention. FIG. 14A is an upper plan view of the attachment 401, and FIG. 14B is a bottom plan view of the attachment 401. And, FIG. 15A is a sectional view taken along the line XVA-XVA of FIG. 14A, and FIG. 15B is a sectional view taken along the line XVB-XVB of FIG. 14A.

The attachment 401 according to the second exemplary embodiment of the present invention includes a plate-shaped main body portion 421 having a rectangular outer shape in plan view, and a supply valve opening portion 424 and an ejection valve opening portion 425, both of which are roughly cylindrical and provided so as to be protruded from the underside of the main body portion 421. Also, the supply valve opening portion 424 and the ejection valve opening portion 425 are connection portions connected to the ink jet head 100, and as shown in FIG. 15B, the protrusion lengths thereof from the underside of the main body portion 421 are equal to each other.

A supply passage 428 through which ink sent to the ink supply port 42 of the reservoir unit 3 passes, and an ejection passage 429 through which ink ejected from the ink ejection port 43 passes are formed in the main body portion 421. The interior of the supply valve opening portion 424 is linked to the supply passage 428. On the other hand, the interior of the ejection valve opening portion 425 is linked with the ejection passage 429. In addition, an ink inlet 421*a* connected to the supply passage 428 and an ink outlet 421*b* connected to the ejection passage 429 are formed in the main body portion 421. Both the ink inlet 421*a* and the ink outlet 421*b* communicate with the upward space. That is, the supply passage 428 extends from the portion to which the supply valve opening portion 424 is connected, to the ink inlet 421*a* at the main body portion 421. On the other hand, the exhaust passage 429 extends from the portion to which the ejection valve opening portion 425 is connected, to the ink outlet 421*b*.

Cylindrical joint portions 427*a* and 427*b* protruding upward are formed on the upper surface of the main body portion 421. The joint portion 427*a* communicates with the ink inlet 421*a*, and the joint portion 427*b* communicates with the ink outlet 421*b*. As shown in FIG. 3, an end part of the supply tube 4*a* connected to the ink tank 4 is connected to the joint portion 427*a*. On the other hand, an end part of the ejection tube 4*b* connected to the ink tank 4 is connected to the joint portion 427*b*.

The supply valve opening portion 424 and the ejection valve opening portion 425 are connected to the main body portion 421 so as to be separated from each other in the width direction of the main body portion 421 in the vicinity of the end part in the lengthwise direction of the main body portion 421 (the left side end part in FIGS. 14A, 14B and FIGS. 15A, 15B). Further, the ink inlet 421*a* and the ink outlet 421*b* are formed at a position in which both are separated from each other in the width direction of the main body portion 421, in the vicinity of the other end part at the opposite side of the side at which the supply valve opening portion 424 and the ejection valve opening portion 425 of the main body portion 421 are connected (the right side end part in FIGS. 14A, 14B and FIGS. 15A, 15B). In further detail, the ink inlet 421*a* is formed at the other end part (the lower end in FIG. 14B) opposite to one end side (the upper end in FIG. 14B) in the width direction of the main body portion 421, to which the supply valve opening portion 424 is connected, and the ink outlet 421*b* is formed at one end side opposite to the other end side in the width direction of the main body portion 421, to which the ejection valve opening portion 425 is connected.

Two annular projections 411 and 413 protruding in a direction orthogonal to the upper surface of the main body portion 421 are formed on the upper surface thereof. On the other hand, two annular projections 412 and 414 protruding in a direction orthogonal to the underside of the main body portion 421 are formed on the underside thereof. Also, films 415 through 418 having flexibility are welded to the distal ends of the annular projections 411 through 414 (that is, the portions meshed in FIGS. 14A and 14B), respectively.

The supply passage 428 comprises the annular projection 411 and the film 415 welded thereto, and the annular projection 412 and the film 416 welded thereto. Also, in the following description, the portion delimited by the annular projection 411 of the supply passage 428 and the film 415 is called an "upper supply passage." On the other hand, the ejection passage 429 comprises the annular projection 413 and the film 417 welded thereto, and the annular projection 414 and the film 418 welded thereto. Further, in the following description, the portion delimited by the annular projection 414 and the film 418 is called a "lower ejection passage."

Since one side of the films 415 through 418 are in contact with the atmosphere, and the other side thereof are in contact with ink, the atmosphere and ink are separated from each other. The films 415 and 416 function as a damper that absorbs a change in pressure when a radial change in pressure occurs in the supply passage 428. On the other hand, the films 417 and 418 function as a damper that absorbs a change in pressure when a radical change in pressure occurs in the ejection passage 429. In addition, the annular projection 411 has a shape of a parallelogram in plan view, and one pair of the sides are formed along both end parts in the width direction of the main body portion 421. That is, the supply passage 428 is widened by the upper supply passage. Therefore, an increased damper effect can be brought about in the upper supply passage.

The annular projection 411 that delimits a part of the supply passage 428 is formed in a range from a portion to which the supply valve opening portion 424 is connected in plan view on the upper surface of the main body portion 421, to the vicinity of the ink inlet 421*a*. Also, the annular projection 412 extends from the vicinity of the ink inlet 421*a* in plan view on the underside of the main body portion 421 to a position at which the ink inlet 421*a* is formed. As shown in FIGS. 14A and 14B, the annular projection 412 is formed along the end edge part of the main body portion 421. With respect to the annular projections 411 and 412, the areas surrounded thereby overlap each other in the vicinity of the ink inlet 421*a* in plan view, and the spaces surrounded thereby communicate with each other. Further, the space surrounded by the annular projection 411 is linked to the interior of the supply valve opening portion 424, and the space surrounded by the annular projection 412 is linked to the ink inlet 421*a*.

The ejection passage 429 extends straight from the portion to which the ejection valve opening portion 425 is connected in plan view, to the portion where the ink outlet 421*b* is formed. The annular projection 413 that delimits a part of the ejection passage 429 extends, on the upper surface of the main body portion 421, from the portion to which the ejection valve opening portion 425 is connected in plan view, to the vicinity of the annular projection 411 toward the portion at which the ink outlet 421*b* is formed. Also, the annular projection 414 extends from the end part at the opposite side of the portion to which the ejection valve opening portion 425 of the annular projection 413 is connected in plan view, to the portion where the ink outlet 421*b* is formed. With respect to the annular projections 413 and 414, the areas surrounded thereby overlap each other at the end parts thereof in plan view, and the spaces surrounded thereby communicate with each other. In addition, the space surrounded by the annular projection 413 is linked to the interior of the ejection valve opening portion 425, and the space surrounded by the annular projection 414 is linked to the ink outlet 421*b*.

As shown in FIGS. 14A and 14B, the upper supply passage of the supply passage 428 and the lower ejection passage of the ejection passage 429 overlap each other in plan view. Therefore, in comparison with a case in which the supply passage 428 and the ejection passage 429 are formed so as not to overlap in plan view, the size of the main body portion 421 can be made smaller in plan view.

Also, in the second exemplary embodiment, a majority of the upper surface of the main body portion 421 is surrounded by the annular projection 411 and is made into an ink passage. By projecting a rib in a direction orthogonal to the surface of the member, the rigidity of the member can be secured. However, since the rib cannot be provided in the passage, there is a concern about a lowering in the rigidity of the member where the passage occupies almost all the surface of the member. Accordingly, the annular projection 414 is arranged on the underside of the main body portion 421 so as to cross almost the middle part of the widening portion of the annular projection 411 in plan view. With such a configuration, the rigidity of the entire main body portion 421 can be maintained.

Also, a roughly U-shaped slit 423*a* is formed along the edge of the portion delimited by the annular projection 413 of the ejection passage 429 in the main body portion 421. Therefore, the portion delimited by the annular projection 413 of the ejection passage 429 is made into a cantilever type beam-shaped passage portion 423. That is, the slit 423*a* extends from one end side of the beam-shaped passage portion 423 to the other end side thereof with respect to a pitch direction (hereinafter, called "connection side pitch direction") connecting the supply valve opening portion 424 and the ejection valve opening portion 425 to each other in plan view. And, the ejection valve opening portion 425 is coupled to the beam-shaped passage portion 423. Accordingly, the ejection valve opening portion 425 is displaceable in the connection side pitch direction while being integral with the beam-shaped passage portion 423.

As shown in FIGS. 15A and 15B, the supply valve opening portion 424 and the ejection valve opening portion 425 is shaped to be tapered with the distal end parts thereof remaining. Further, a plurality of slits 424*a* and 425*a* are formed at the distal end of the supply valve opening portion 424 and the ejection valve opening portion 425, respectively. The supply valve opening portion 424 presses the movable member 76 of the supply valve mechanism 70 downward opposite to the pressing direction by the pressing spring 79 when the attachment 401 is attached to the ink jet head 100. The movable member 76 is moved to the opening position, and the supply valve mechanism 70 is opened. On the other hand, the ejection valve opening portion 425 presses the movable member 86 of the ejection valve mechanism 80 downward opposite to the pressing direction by the pressing spring 89. The movable member 86 is moved to the opening position, and the ejection valve mechanism 80 is opened. At this time, the supply passage 428 of the attachment 401 communicates with the inflow passage 32*a* of the upper reservoir forming body 30 via the slits 424*a*, and the ejection passage 429 communicates with the outflow passage 32*b* via the slits 424*b*.

Here, referring to FIGS. 11A and 11B, a description will be given for actions when attaching the attachment 401 to the ink jet head 100. FIG. 11A shows a state before the supply valve mechanism 70 is closed, and FIG. 11B shows a state where the supply valve mechanism 70 is opened. Also, since the opening and closing actions of the ejection valve mechanism 80 are similar to those of the supply valve mechanism 70, only the opening and closing actions of the supply valve mechanism 70 will be described herein.

First, as shown in FIG. 11A, when the attachment 401 is attached to the ink jet head 100, the supply valve opening portion 424 and the ejection valve opening portion 425 of the attachment 401 are, respectively, inserted into the interior of the supply valve mechanism 70 and that of the ejection valve mechanism 80. At this time, if there is a difference between the pitch direction connecting the supply valve mechanism 70 and the ejection valve mechanism 80 (hereinafter, called "connected side pitch direction") to each other and the connection side pitch direction of the attachment 401 in plan view, the ejection valve opening portion 425 is appropriately displaced in the connection side pitch direction.

Also, at this time, in further detail, the ejection valve opening portion 424 is inserted into the interior of the minor-diameter portion 75 of the fixing member 73 in the supply valve mechanism 70 and into the communication passage 72 of the communication member 71, and the distal end thereof is brought into contact with the movable member 76 of the supply valve mechanism 70. By pressing the attachment 401 downward, the distal end of the supply valve opening portion 424 presses the movable member 76 of the supply valve mechanism 70 downward opposite to the pressing direction by the pressing spring 79. Thereby, the movable member 76 moves from the sealing position shown in FIG. 11A to the opening position shown in FIG. 11B, in which the supply valve mechanism 70 is brought into an opening state. That is, ink in the supply passage 428 of the attachment 401 flows from the slit 424*a* at the distal end of the supply valve opening portion 424 into the interior of the joint portion 433.

Here, as shown in FIG. 6, an annular projection 71*a* swelled inwardly from the inner wall at an intermediate part of the communication passage 72 is formed at the communication member 71. The annular projection 71*a* is brought into contact with the outer circumferential surface of the supply valve opening portion 424 at the point of time when the above-described distal end of the supply valve opening portion 424 is brought into contact with the movable member 76. The communication member 71 is made of a resin-made flexible material such as rubber, and is brought into contact with the supply valve opening portion 424 to form a water-tight seal. Even if the supply valve opening portion 424 is further pressed, and ink temporarily flows reversely through clearance between the communication member 71 and the movable member 76, there is no case where ink leaks outside.

As described above, in the attachment 401 according to the second exemplary embodiment, the main body portion 421 includes a beam-shaped passage portion 423 delimited by the slits 423*a* formed along the edge of the portion delimited by the annular projection 413 of the ejection passage 429. And, the ejection valve opening portion 425 is coupled to the beam-shaped passage portion 423 so as to be displaceable in the connection side pitch direction. Therefore, even in a case in which a difference exists between the connection side pitch direction of the attachment 401 and the connected side pitch direction of the ink jet head 100, a load given to the ink supply port 42 and the ink ejection port 43 can be reduced by displacing the beam-shaped passage portion 423 in the connection side pitch direction along with the ejection valve opening portion 425 coupled thereto.

Also, in the attachment 401 according to the second exemplary embodiment, the slit 423*a* extends roughly in the form of a U-shape from one side to the other side with respect to the connection side pitch direction of the beam-shaped passage portion 423, and the beam-shaped passage portion 423 is coupled to the main body portion 421 as a cantilever beam. Therefore, in comparison with a case in which the beam-shaped passage portion is supported at both sides, it is possible to increase the amount of displacement in regard to the beam-shaped passage portion 423. Therefore, it is possible to reliably reduce the load given to the ink supply port 42 and the ink ejection port 43.

Further, in the attachment 401 according to the second exemplary embodiment, the beam-shaped passage portion 423 comprises a part of the ejection passage 429. Also, the supply passage 428 is widened by the upper supply passage, which includes the annular projection 411 and the film 415. Therefore, since the upper supply passage that exerts an increased damper effect is formed not at the displaceable beam-shaped passage portion 423 but at the supply passage 428 of the main body portion, a stabilized damper effect can be generated.

Modified Versions of the Second Exemplary Embodiment

First Modified Version

Figure 16:
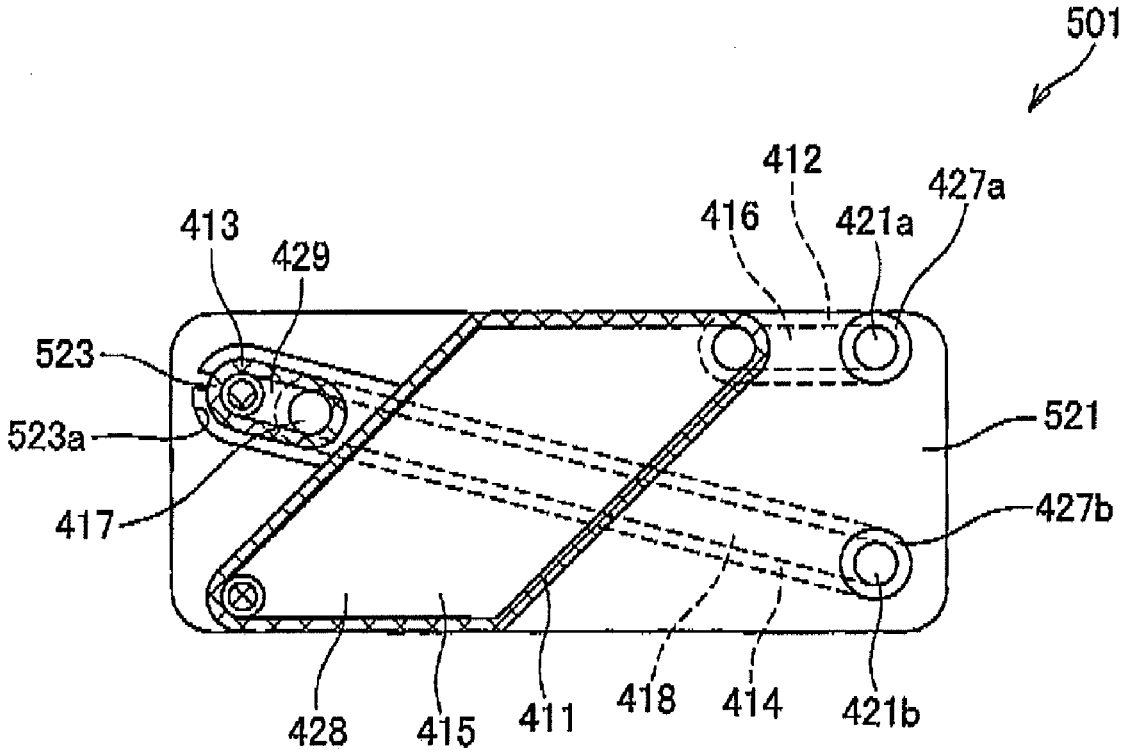
FIG. 16 is a view showing an attachment according to a first modified version of the second exemplary embodiment.

A description will now be given of a first modified version of the second exemplary embodiment with reference to FIG. 16. FIG. 16 is an upper plan view of attachment 501 according to the first modified version of the second exemplary embodiment. The attachment 501 first modified version of the second exemplary embodiment is such that the configuration of the slits 423*a* according to the second exemplary embodiment described above is modified, but other configurations are similar to those of the second exemplary embodiment described above. Further, components that have a similar configuration as that of the embodiment described above are given the same reference numerals.

Two slits 523*a* extending along both sides in regard to the pitch direction of the portion delimited by the annular projection 413 of the ejection passage 429 are formed at the main body portion 521 of the attachment 501. Thereby, the portion delimited by the annular projection 413 of the ejection passage 429 is made into a beam-shaped passage portion 523, which is supported at both sides, and is connected to the main body portion 521 at both ends of the extension direction thereof. And, the ejection valve opening portion 425 is coupled to the beam-shaped passage portion 523, and is made displaceable in the connection side pitch direction while being integral with the beam-shaped passage portion 523.

The attachment 501 according to the first modified version can reduce a load given to the ink supply port 442 of the ink jet head 100 and the ink ejection port 443 thereof as in the attachment 401 according to the second exemplary embodiment described above.

Also, since, in the attachment 501 according to the first modified version, the beam-shaped passage portion 523 is like a beam supported at both sides. Accordingly, it is possible to restrict displacement of the beam-shaped passage portion 523 in regard to the attaching direction (that is, the up and down direction) thereof to the ink jet head 100. Therefore, it is possible to prevent the connection from becoming poor due to floating of the ejection valve opening portion 425 coupled to the beam-shaped passage portion 523 when attaching the attachment 501 to the ink jet head 100.

Second Modified Version

Figure 17A:
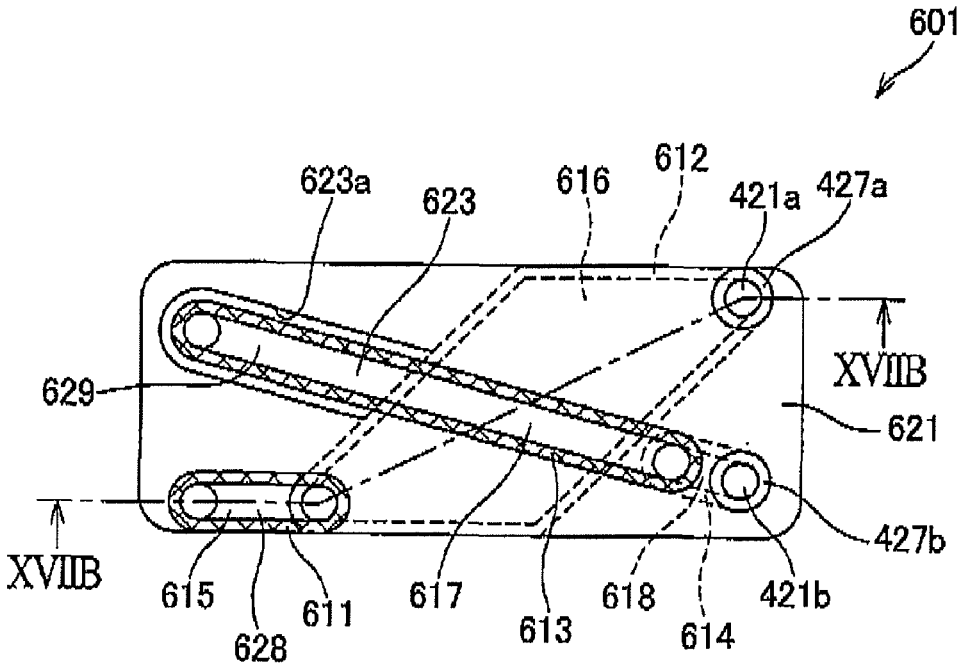
FIGS. 17A and 17B are views showing an attachment according to a second modified version of the second exemplary embodiment.
Figure 17B:
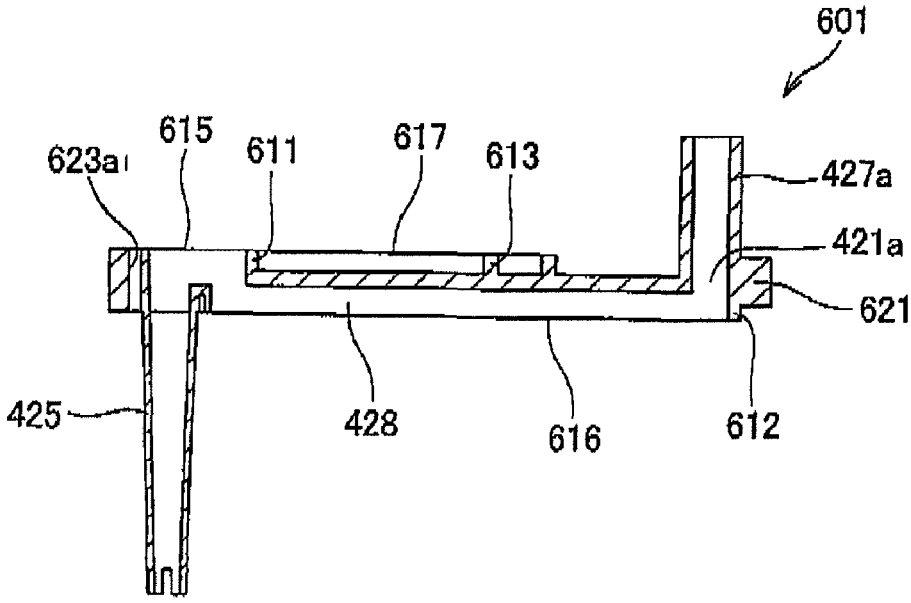

Referring to FIGS. 17A and 17B, a description will be given for a second modified version of the second exemplary embodiment. FIG. 17A is an upper plan view of an attachment according to the second modified version of the second exemplary embodiment, and FIG. 17B is a sectional view taken along the line XVIIB-XVIIB in FIG. 17A. The attachment 601 according to the second modified version of the second exemplary embodiment is such that the passage configuration of the supply passage 428 and the ejection passage 429, which are formed in the main body portion 421 according to the second exemplary embodiment described above is modified, but other configurations are similar to those of the second exemplary embodiment described above. Also, components that have a configuration similar to that of the embodiment described above are given the same reference numerals.

The supply passage 628 formed in the attachment 601 according to the second modified version comprises an annular projection 611 formed on the upper surface of the main body portion 621, an annular projection 612 formed on the underside of the main body portion 621, and flexible films 615 and 616 welded to the distal ends thereof. The annular projection 611 slightly extends from a portion to which the supply valve opening portion 424 is connected, in the vicinity of one end part (the left side end part in FIGS. 17A and 17B) in the lengthwise direction of the main body portion 621 in plan view, toward the other end part thereof (the right side end part in FIGS. 17A and 17B). The annular projection 612 has a shape of a parallelogram in plan view and is formed between the vicinity of the portion to which the supply valve opening portion 424 of the main body portion 621 is connected, and the ink inlet 421*a*. With respect to the annular projections 611 and 612, the areas surrounded thereby overlap each other in the vicinity of the portion to which the supply valve opening portion 424 is connected in plan view, and the spaces surrounded thereby communicate with each other. In addition, the space surrounded by the annular projection 611 is linked to the interior of the supply valve opening portion 424, and the space surrounded by the annular projection 612 is linked to the ink inlet 421*a*.

As described above, in the supply passage 628 according to the second modified version of the second exemplary embodiment, the passage is widened by the portion delimited by the annular projection 612 and film 516, which are formed on the underside of the main body portion 621, and an increased damper effect can be generated. That is, the portion that can exert an increased damper effect is formed on the underside of the main body portion.

On the other hand, the ejection passage 629 comprises an annular projection 613 formed on the upper surface of the main body portion 621, an annular projection 614 formed on the underside of the main body portion 621 and flexible films 517 and 518 welded to the distal ends thereof. The annular projection 613 extends straight from the portion to which the ejection valve opening portion 425 is connected in plan view, to the vicinity of the ink outlet 421*b*. The annular projection 614 extends from the vicinity of the ink outlet 421*b* to the ink outlet 421*b* in plan view. With respect to the annular projection 613 and the annular projection 614, the areas surrounded thereby overlap each other in the vicinity of the ink outlet 421*b* in plan view, and spaces surrounded thereby communicate with each other. Also, the space surrounded by the annular projection 613 is linked to the interior of the ejection valve opening portion 425, and the space surrounded by the annular projection 614 is linked to the ink outlet 421*b*.

As shown in FIGS. 17A and 17B, in the second modified version, the annular projection 612 that delimits a part of the supply passage 628 and the annular projection 613 that delimits a part of the ejection passage 629 partially overlap each other in plan view. And, a slit 623*a* is formed to be roughly U-shaped along the edge of the portion delimited by the annular projection 613 of the ejection passage 629. In further detail, the slit 623*a* is a portion that does not overlap the supply passage 628 in plan view in the ejection passage 629, and is formed along the edge of the portion to which the ejection valve opening portion 425 is connected. And, a cantilever beam-shaped portion delimited by the slit 623*a* of the ejection passage 629 is made into a beam-shaped passage portion 623.

The attachment 601 according to the second modified version can reduce a load given to the ink supply port 42 and the ink ejection port 43 of the ink jet head 100 as in the attachment 401 according to the second exemplary embodiment described above.

In addition, in the attachment 601 according to the second modified version, a portion that exerts a comparatively increased damper effect in the supply passage 628 is formed on the underside of the main body portion 621, and when the attachment 601 is attached to the ink jet head 100, the attachment 601 is nipped between the ink jet head 100 and the main body portion 621. Therefore, it is possible to prevent the damper portion from being given an unnecessary force from the periphery.

Third Exemplary Embodiment

Figure 18A:
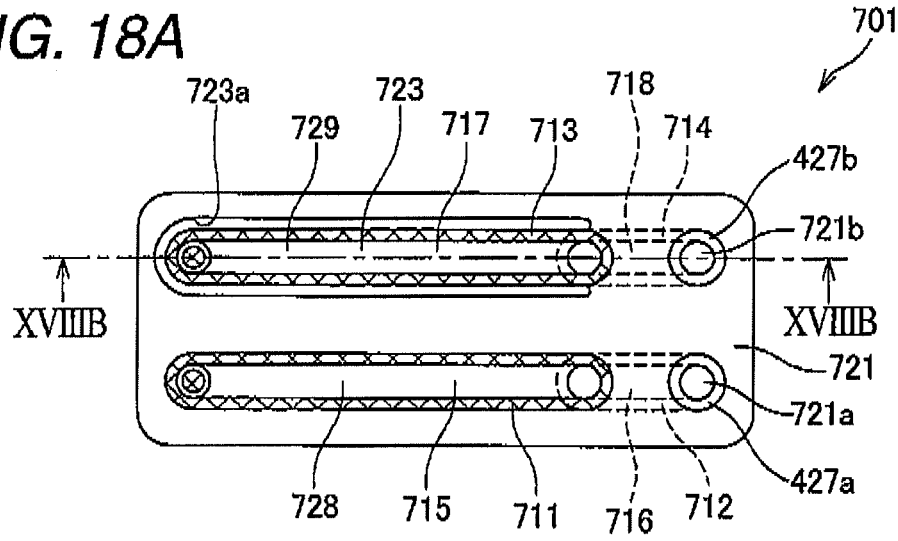
FIGS. 18A through 18C are views showing an attachment according to a third exemplary embodiment of the invention.
Figure 18B:
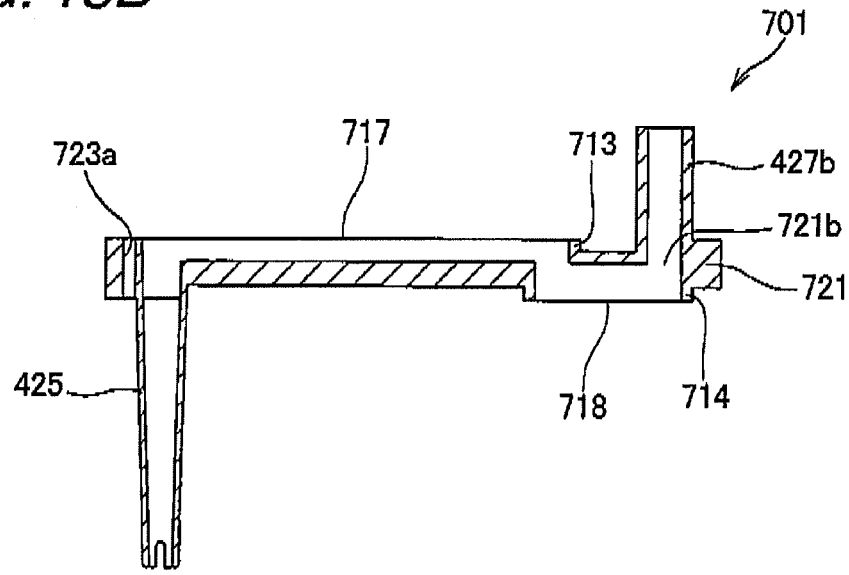
Figure 18C:
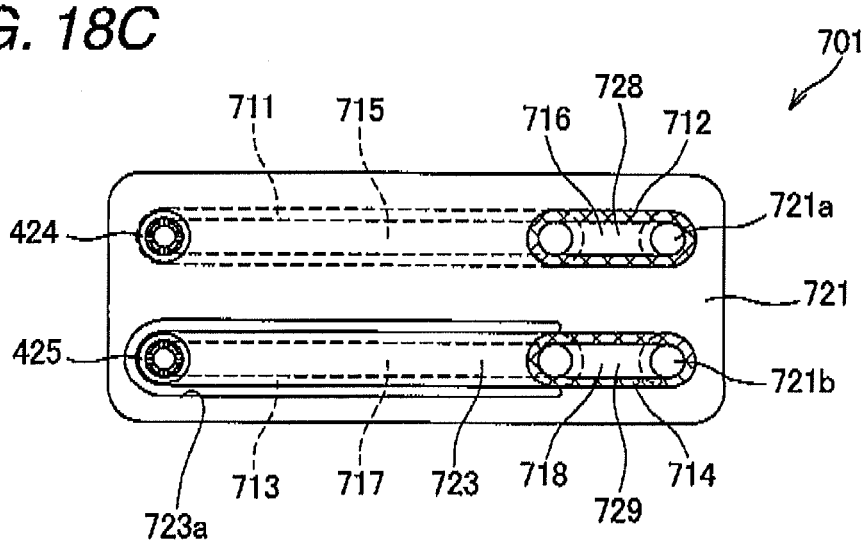

Next, a description will be given of a third exemplary embodiment of the invention with reference to FIGS. 18A through 18C. FIG. 18A is an upper plan view of attachment 701 according to the third exemplary embodiment, FIG. 18B is a sectional view taken along the line XVIIIB-XVIIIIB in FIG. 18A, and FIG. 18C is a bottom plan view of the attachment 701. The configuration of the attachment 701 according to the third exemplary embodiment differs from the attachment 401 according to the second exemplary embodiment in that, as described above, although the supply passage 428 and the ejection passage 429 according to the second exemplary embodiment partially overlap each other in plan view, the supply passage and the ejection passage do not overlap in plan view in the third exemplary embodiment. Otherwise, the configuration of the ink jet head to which the attachment 701 according to the third exemplary embodiment is attached is similar to that of the second exemplary embodiment described above, and a description thereof is therefore omitted. In addition, the configuration other than the passage configuration of the attachment 701 according to the third exemplary embodiment is almost the same as the attachment 401 according to the second exemplary embodiment. Therefore, components having the same configuration as those of second exemplary embodiment are given the same reference numerals, and a description thereof is also omitted.

As shown in FIGS. 18A through 18C, in the attachment 701 according to the third exemplary embodiment, the supply valve opening portion 424 and the ejection valve opening portion 425 are connected to the main body portion 721 so as to be separated from each other in the width direction of the main body portion 721 in the vicinity of one end part (the left side end part in FIGS. 18A through 18C) in the lengthwise direction of the main body portion 721 as in the configuration according to the second exemplary embodiment. On the other hand, the ink inlet 721*a* is formed at the same side as the side (the upside in FIG. 18C), on which the supply valve opening portion 424 is connected with respect to the width direction of the main body portion 721, in the vicinity of the other end part (the right side end part in FIGS. 18A through 18C) in the lengthwise direction of the main body portion 721. Also, the ink outlet 721*b* is formed at the same side as the side (the downside in FIG. 18C), on which the ejection valve opening portion 425 is connected with respect to the width direction of the main body portion 721, in the vicinity of the other end part in the lengthwise direction of the main body portion 721.

And, the supply passage 728 extends straight from the portion to which the supply valve opening portion 424 is connected, to the ink inlet 721*a* in the main body portion 721. On the other hand, the ejection passage 729 extends straight from the portion to which the ejection valve opening portion 425 is connected, to the ink outlet 721*b*. The supply passage 728 and the ejection passage 729 extend in parallel to each other along the lengthwise direction of the main body portion 721 in plan view. In addition, the supply passage 728 comprises annular projections 711 and 712 described later and flexible films 715 and 716 welded to the distal ends thereof. The ejection passage 729 comprises annular projections 713 and 714 and flexible films 717 and 718 welded to the distal ends thereof.

The annular projection 711 formed on the upper surface of the main body portion 721 extends straight from the portion to which the supply valve opening portion 424 is connected in plan view, to the vicinity of the ink inlet 721*a*. Also, the annular projection 712 formed on the underside of the main body portion 721 extends from the vicinity of the ink inlet 721*a* in plan view to the portion to which the ink inlet 721*a* is formed. With respect to the annular projections 711 and 712, the areas surrounded thereby overlap each other in the vicinity of the ink inlet 721*a* in plan view, and spaces surrounded thereby communicate with each other. Also, the space surrounded by the annular projection 711 is linked to the interior of the supply valve opening portion 424, and the space surrounded by the annular projection 712 is linked to the ink inlet 721*a*.

The annular projection 713 formed on the upper surface of the main body portion 721 extends straight from the portion to which the ejection valve opening portion 425 in plan view, to the vicinity of the ink outlet 721*b*. Also, the annular projection 714 formed on the underside of the main body portion 721 extends straight from the vicinity of the ink outlet 721*b* in plan view to the portion where the ink outlet 721*b* is formed. With respect to the annular projections 713 and 714, the areas surrounded thereby overlap each other in the vicinity of the ink outlet 721*b* in plan view, and the spaces surrounded thereby communicate with each other. Further, the space surrounded by the annular projection 713 is linked to the interior of the ejection valve opening portion 425, and the space surrounded by the annular projection 714 is linked to the ink outlet 721*b*.

Further, a roughly U-shaped slit 723*a* is formed along the edge of the portion delimited by the annular projection 713 of the ejection passage 729 in the main body portion 721. Therefore, the portion delimited by the annular projection 713 of the ejection passage 729 is made into a cantilever type beam-shaped passage portion 723. That is, the slit 723*a* extends from one side of the beam-shaped passage portion 723 to the other side thereof with respect to the connection side pitch direction in plan view. And, the ejection valve opening portion 425 is coupled to the beam-shaped passage portion 723. Therefore, the ejection valve opening portion 425 is made displaceable in the connection side pitch direction while being integral with the beam-shaped passage portion 723.

The attachment 701 according to the third exemplary embodiment can reduce a load given to the ink supply port 42 and the ink ejection port 43 of the ink jet head 100 as in the attachment 401 according to the exemplary embodiments described above.

Exemplary embodiments of the present invention have been described above. However, the present invention is not limited to the above-described exemplary embodiments. The inventive concept may be subjected to various design modifications within the scope of Claims. For example, in the second and third exemplary embodiments described above, a description has been given of a case in which the ejection valve opening portion 425 is displaceable in the connection side pitch direction along with the beam-shaped passage portion 423 (723) delimited by the slits 423*a* (723*a*). However, the ejection valve opening portion 425 is not limited thereto. The slits may be formed along a part of the supply passage 428, and the supply valve opening portion 424 may be displaceable in the connection side pitch direction along with the beam-shaped passage portion delimited by such slits.

In addition, in the second exemplary embodiment, a description has been given of a case in which a part of the ejection passage 429 comprises the beam-shaped passage portion 423, and at the same time, the supply passage 428 is widened in the portion delimited by the annular projection 411 and has a comparatively increased damper effect. However, the invention is not limited thereto. That is, a damper portion having a comparatively increased damper effect may be formed in the beam-shaped passage portion.

Further, in the second and third exemplary embodiments, a description has been given of a case in which the protruding lengths of the supply valve opening portion 424 and the ejection valve opening portion 425 from the underside of the main body portion 421 (721) are equal to each other. However, the protruding lengths may differ from each other. Also, where the protruding lengths are different from each other, it is possible to prevent the ink jet head 100 from being mounted in an erroneous direction of attachment.

An auxiliary passage unit according to an illustrative aspect of the invention may be detachably attached to a liquid drop discharge head having a liquid passage for distributing liquid to a plurality of nozzles that discharge liquid drops to a recording medium, a liquid supply port for supplying liquid to the liquid passage, and a liquid ejection port for ejecting liquid from the liquid passage. The auxiliary passage unit is provided with a plate-shaped main body portion having a supply passage through which a liquid sent to the liquid supply port passes, and an ejection passage through which a liquid ejected from the liquid ejection port passes, at least a part of the supply passage comprising a first annular projection formed to protrude in a direction orthogonal to one surface of the main body portion on the corresponding surface thereof, and a first flexible film adhered to the distal end of the first annular projection, and at least a part of the ejection passage crosses an area opposed to the area surrounded by the first annular projection in plan view on the other surface of the main body portion.

With this configuration, in comparison with a case in which the supply passage and the ejection passage are formed so as not to overlap each other in plan view, the size of the main body portion in plan view can be reduced. In addition, since the rigidity of the portion at which the first annular projection of the main body portion is formed can be increased by the ejection passage, deformation thereof can be prevented.

In the auxiliary passage unit, it is advantageous that the segment connecting the first inflow port of liquid and the first outflow port thereof at a portion surrounded by the inner circumferential surface of the first annular projection and the first film and the segment connecting the second inflow port of liquid and the second outflow port thereof at a portion formed on the other surface of the ejection passage cross each other in plan view. With this configuration, it is possible to balance the rigidity of the main body portion.

In the auxiliary passage unit, the first annular projection may include opposite portions disposed along both end edge portions of the main body portion so that the first annular projection communicates from the first inflow port to the first outflow port via a widening portion the passage of which is widened, so as to be tapered, and the ejection passage may be formed so as to cross the linkage portion, by which the opposite portions in the first annular projection are linked to each other, in plan view. With this configuration, the supply passage can exert in increased damper effect at the widening portion. Also, simultaneously, it is possible to effectively prevent the rigidity of the widening portion from being lowered by the ejection passage crossing the widening portion of the supply passage in plan view.

In the auxiliary passage unit, the ejection passage may be formed so as to protrude in a direction orthogonal to the other surface of the main body portion on the corresponding surface thereof and may comprise the second annular projection that straightly extends from the second inflow port toward the second outflow port, and the second flexible film adhered to the distal end of the second annular projection. With the configuration, the ejection passage will have a damper effect, and can further prevent a change in pressure in liquid. Furthermore, it is possible to further effectively prevent the rigidity at the widening portion of the supply passage from being lowered, by the second annular projection that extends in a straight manner.

Also, any one of the auxiliary passage unit described above may be attached to a liquid discharge head.

An attachment according to an illustrative aspect of the invention is detachably attached to an ink jet head including an ink passage for distributing ink to a plurality of nozzles that discharge ink drops to a recording medium, an ink supply port for supplying ink to the ink passage, and an ink ejection port for ejecting ink from the ink passage. The attachment is formed of a plate-shaped member having a rectangular shape in plan view, which is provided with a main body portion formed on one surface thereof and having a supply passage through which ink supplied into the ink supply port passes, and an ejection passage formed on the other surface thereof and having an ejection passage through which ink ejected from the ink ejection port passes, a first hollow communication tube protruding from the other surface of the main body portion and causing the supply passage and the ink supply port to communicate with each other via slits formed at the distal ends thereof, and a second hollow communication tube protruding from the surface having the first communication tube formed thereon and causing the ejection passage and the ink ejection port to communicate with each other via slits formed at the distal ends thereof. In addition, at least a part of the supply passage comprises a first annular projection having opposite portions extending along parallel end edge portions of the main body portion on one surface of the main body portion and formed so as to protrude in a direction orthogonal to the surface, and a first flexible damper film adhered to the distal end of the corresponding first annular projection. At least a part of the ejection passage extends in a straight manner from one end edge portion of the main body portion to the other end edge portion so as to cross the linkage portion in plan view, the linkage portion connecting the opposite portions at the first annular projection, respectively, on the other surface of the main body portion. The at least a part of the ejection passage comprises the second annular projection protruding in a direction orthogonal to the other surface and the second damper film having flexibility, which is attached to the distal end of the corresponding second annular projection.

With this configuration, in comparison with a case in which the supply passage and the ejection passage are formed so as not to overlap each other in plan view, the size of the main body portion in plan view can be made smaller. Also, since the rigidity of a portion at which the first annular projection of the main body portion is formed by the ejection passage can be increased, deformation thereof can more easily be prevented from occurring.

In the attachment, the lengths of the first communication tube and the second communication tube from the main body portion to the distal ends thereof may differ from each other. With the configuration, it is possible to prevent the attachment from being attached to the ink jet head in an erroneous direction of attachment.

In addition, any one of the attachments described above may be attached to an ink jet head. Further, an ink jet printer may be provided with the ink jet head described above.

An attachment according to another illustrative aspect of the present invention includes a plurality of nozzles for discharging ink drops to a recording medium, an ink passage connecting the plurality of individual ink passages to a plurality of nozzles, an ink supply port for supplying ink to the ink passage, and an ink ejection port for ejecting ink from the ink passage, the attachment being attached to the ink jet head. The attachment is provided with a main body portion formed of a material having flexibility, in which a supply passage through which ink supplied to the ink supply port flows and an ejection passage through which ink ejected from the ink ejection port flows are formed, and with two connection portions being a passage member protruding from one surface of the main body portion, one of which connects the supply passage to the ink supply port and the other of which connects the ejection passage to the ink ejection port when the attachment is attached to the ink jet head. The main body portion includes a beam-shaped passage portion delimited by slits formed along both sides of either the supply passage or the ejection passage with respect to the pitch direction connecting two connection portions on one surface described above, and the corresponding connection portion of the two connection portions is linked to the beam-shaped passage portion displaceably in the pitch direction.

With this configuration, even in a case in which there is unevenness between the pitch of the ink supply port and the ink ejection port of the ink jet head and the pitch of two connection portions, a load given to the ink supply port and the ink ejection port can be reduced by displacing the beam-shaped passage portion in the pitch direction together with the connection portion linked thereto.

Since, in the attachment, the slits formed on both sides of the beam-shaped passage portion are linked to each other at one end of the corresponding beam-shaped passage portion, the beam-shaped passage portion displaceable in the pitch direction may be linked to the main body portion as a cantilever beam. With this configuration, the amount of displacement of the beam-shaped passage portion can be increased. Therefore, the load given to the ink supply port and the ink ejection port can reliably be reduced.

In the attachment, the beam-shaped passage portion displaceable in the pitch direction may be linked to the main body portion as a beam supported at both ends. With this configuration, it is possible to restrict displacement of the beam-shaped passage portion with respect to the attaching direction to the ink jet head. Therefore, when attaching the attachment to the ink jet head, it is possible to prevent poor connection from occurring due to floating the connection portion linked to the beam-shaped passage portion.

In the attachment, at least a part of the ejection passage comprises the beam-shaped passage portion, and at least a part of the supply passage comprises an annular projection protruding in a direction orthogonal to either one of one surface described above or the other surface opposed to the surface and a flexible damper film fixed at the distal end of the annular projection. With this configuration, since the damper portion is formed not at the displaceable beam-shaped passage portion but at the supply passage of the main body portion, a stabilized damper effect can be generated.

In the attachment, the annular projection and the damper film may be disposed at one surface side of the main body portion. With this configuration, the damper portion is formed at the same side as the side where the connection portion of the main body portion is formed. That is, when attaching the attachment to the ink jet head, the damper portion is nipped between the ink jet head and the main body portion, wherein the damper is hardly subjected to any unnecessary force from the periphery.

Further, any one of the attachments described above may be attached to an ink jet head. Further, an ink jet printer may be provided with the ink jet head described above.

As described above, in comparison with a case in which the supply passage and the ejection passage are formed so as not to overlap each other in plan view, the size of the main body portion in plan view can be reduced. In addition, since the rigidity of the portion at which the first annular projection of the main body portion is formed by the ejection passage can be increased, deformation thereof can be prevented from occurring.

As described above, even in a case in which there is unevenness between the pitch of ink supply port and ink ejection port of the ink jet head and the pitch of two connection portions of the attachment, the beam-shaped passage portion can be displaced in the pitch direction along with the connection portion to which the beam-shaped passage portion is linked, wherein a load given to the ink supply port and the ink ejection port can be reduced.

While the present invention has been shown and described with reference to certain exemplary embodiments thereof, it will be understood by those skilled in the art that various changes in form and details may be made therein without departing from the spirit and scope of the invention as defined by the appended claims.

The invention claimed is:

1. An auxiliary passage apparatus which is detachably attached to a liquid discharge head, the auxiliary passage apparatus comprising:

a main body portion comprising, a first surface, a second surface, a supply passage formed in the first surface and through which liquid passes to the liquid discharge head, and an ejection passage formed in the second surface and configured to receive liquid which is ejected from the liquid discharge head;

wherein at least a part of the supply passage comprises a first annular projection formed so as to protrude in a direction orthogonal to the first surface and a first flexible film adhered to a distal end of the first annular projection; and at least a part of the ejection passage crosses an area on the second surface which is opposed to an area surrounded by the first annular projection.

2. The auxiliary passage apparatus according to claim 1, wherein the main body portion further comprises a first inflow port, a second inflow port, a first outflow port, and a second outflow port, and a first segment connecting the first inflow port at a portion surrounded by an inner circumferential surface of the first annular projection and the first film with the first outflow port, and a second segment connecting the second inflow port at a portion formed on the second surface of the ejection passage with the second outflow port cross each other in plan view.

3. The auxiliary passage apparatus according to claim 2, wherein the first annular projection comprises two opposite portions disposed along respective end edge portions of the main body portion such that the first annular projection communicates from the first inflow port to the first outflow port via a widening portion, the widening portion being tapered at the first inflow port and the first outflow port, and two linkage portions that connect the two opposite portions to each other; and the ejection passage is formed so as to cross the two linkage portions.

4. The auxiliary passage apparatus according to claim 1, wherein the main body portion further comprises a second inflow port and a second outflow port, and the ejection passage is formed so as to protrude in a direction orthogonal to the second surface of the main body portion, and the ejection passage comprises a second annular projection which extends in a substantially straight direction from the second inflow port toward the second outflow port, and a second flexible film adhered to the distal end of the second annular projection.

5. A liquid discharge head comprising:

a liquid passage which distributes liquid to a plurality of nozzles that discharge liquid drops onto a recording medium;

a liquid supply port which supplies liquid to the liquid passage; a liquid ejection port which ejects liquid from the liquid passage; and an auxiliary passage unit which is detachably attached to the liquid supply port and the liquid ejection port, and which comprises:

a main body portion comprising, a first surface, a second surface, a supply passage formed in the first surface and through which liquid passes to the liquid discharge head, and an ejection passage formed in the second surface and configured to receive liquid which is ejected from the liquid discharge head;

wherein at least a part of the supply passage comprises a first annular projection formed so as to protrude in a direction orthogonal to the first surface and a first flexible film adhered to a distal end of the first annular projection; and at least a part of the ejection passage crosses an area on the second surface which is opposed to an area surrounded by the first annular projection.

6. An ink jet head comprising:

an ink passage which distributes ink to a plurality of nozzles that discharge ink drops onto a recording medium;

an ink supply port which supplies ink to the ink passage;

an ink ejection port which ejects ink from the ink passage; and an attachment which is detachably attached to the ink supply port and the ink ejection port, and which comprises:

a main body portion comprising a first surface, a second surface, a supply passage formed on the first surface and through which ink supplied to the ink jet head passes, and an ejection passage formed on the second surface and configured to receive ink ejected from the ink jet head;

a first hollow communication tube protruding from the second surface and comprising a first slit formed in a distal end thereof through which the supply passage and the ink jet head communicate with each other; and a second hollow communication tube protruding from the second surface and comprising a second slit formed in a distal end thereof through which the ejection passage and the ink jet head communicate with each other;

wherein at least a part of the supply passage comprises opposite portions, each of which extends along an end edge portion parallel to the main body portion on the first surface, linkage portions that connect the opposite portions to each other, and a first flexible film adhered to the distal ends of the opposite portions and the linkage portions; and at least a part of the ejection passage comprises a second annular projection, which extends in a substantially straight manner from one end edge part of the main body portion toward the other end edge part thereof so as to cross the linkage portions, the second annular projection protruding in a direction orthogonal to the second surface, and a second flexible film adhered to the distal end of the second annular projection.

7. An ink jet printer including an ink jet head according to claim 6.

* * * * *